US009016084B2

(12) United States Patent
Alden et al.

(10) Patent No.: US 9,016,084 B2
(45) Date of Patent: Apr. 28, 2015

(54) PRESSURE SWING ADSORPTION / DESORPTION HEATING, COOLING, AND ENERGY STORAGE PROCESS AND APPARATUS

(76) Inventors: Ray M. Alden, Raleigh, NC (US); James A. Ritter, Gilbert, SC (US); Armin D. Ebner, Lexington, SC (US)

( * ) Notice: Subject to any disclaimer, the term of this patent is extended or adjusted under 35 U.S.C. 154(b) by 426 days.

(21) Appl. No.: 13/507,558

(22) Filed: Jul. 10, 2012

(65) Prior Publication Data

US 2012/0324931 A1 Dec. 27, 2012

Related U.S. Application Data

(63) Continuation-in-part of application No. 12/217,575, filed on Jul. 7, 2008, now abandoned, and a continuation-in-part of application No. 12/586,784, filed on Sep. 26, 2009, now Pat. No. 8,209,992, and a continuation-in-part of application No. 12/653,521, filed on Dec. 15, 2009, now abandoned, and a continuation-in-part of application No. 12/799,103, filed on Apr. 16, 2010, now abandoned.

(60) Provisional application No. 61/572,091, filed on Jul. 11, 2011.

(51) Int. Cl.
*F25B 29/00* (2006.01)
*F25B 27/00* (2006.01)

(52) U.S. Cl.
CPC ..... *F25B 29/006* (2013.01); *F25B 27/00* (2013.01)

(58) Field of Classification Search
CPC ..... F25B 29/006
USPC ..... 62/157, 402; 95/114
See application file for complete search history.

(56) References Cited

U.S. PATENT DOCUMENTS

| | | | | |
|---|---|---|---|---|
| 4,152,901 | A * | 5/1979 | Munters | 62/112 |
| 4,184,338 | A * | 1/1980 | Bennett | 62/235.1 |
| 5,360,057 | A * | 11/1994 | Rockenfeller et al. | 165/104.12 |
| 6,490,875 | B2 * | 12/2002 | Chua et al. | 62/144 |
| 7,384,454 | B2 * | 6/2008 | Tongue | 95/114 |
| 2003/0015093 | A1 * | 1/2003 | Wegeng et al. | 95/114 |
| 2006/0150665 | A1 * | 7/2006 | Weimer et al. | 62/476 |
| 2007/0089449 | A1 * | 4/2007 | Gurin | 62/324.2 |
| 2011/0100036 | A1 * | 5/2011 | Farmer | 62/101 |
| 2011/0167842 | A1 * | 7/2011 | Paulussen | 62/79 |
| 2011/0314856 | A1 * | 12/2011 | Willgohs | 62/235.1 |

* cited by examiner

*Primary Examiner* — Mohammad M Ali
*Assistant Examiner* — Emmanuel Duke

(57) ABSTRACT

The invention described herein enables a variety of heating, cooling, energy transformation, and energy storage options with a small number or components. Described are Pressure Swing Adsorption and Pressure Swing Desorption cycles, processes, and apparatuses including multiple sorption beds and active energy input by a pump and energy storage as pressure differentials. A preferred embodiment includes two zeolite 13X sorption beds, CO2 adsorbate, solenoid valves, and a compressor pump. In operation these components provide a range of heating, cooling, and energy storage options. Operational cycles are described.

16 Claims, 13 Drawing Sheets

Figure 1B:
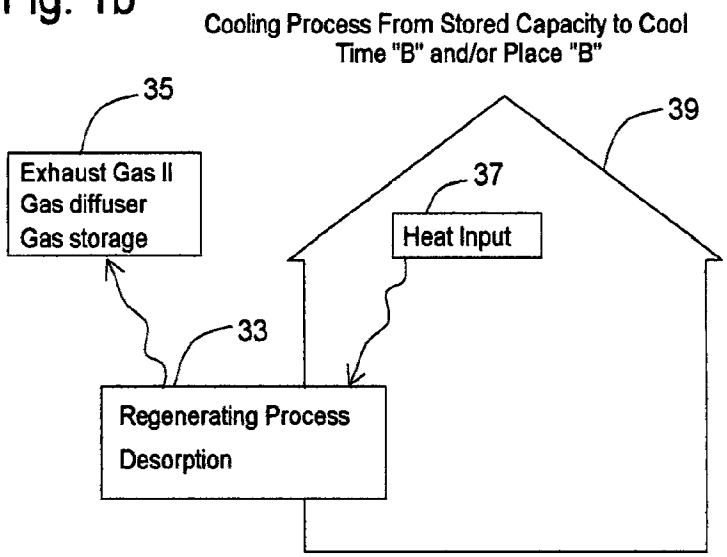

Prior Art - Pressure Swing Adsorption "Heatless" Air Dryer
Concurrent Heat In/Out Concurrent Adsorption/Desorption Present Art - Pressure Swing Adsorption Heating and Storing Energy "Capacity to Cool"
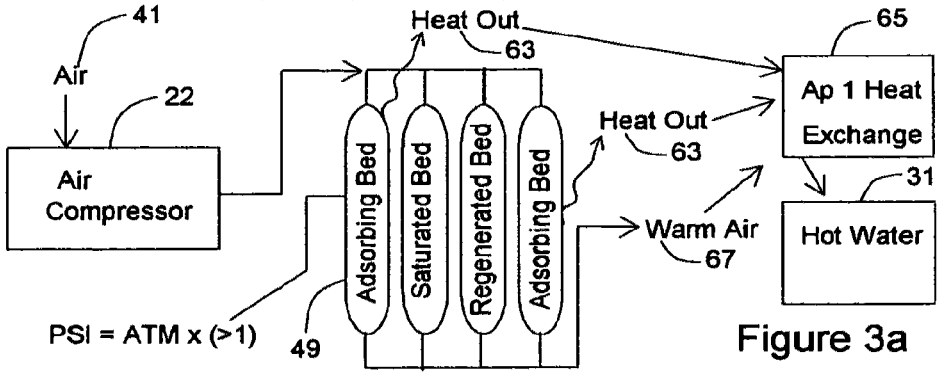
Figure 3a
Present Art - Pressure Swing Adsorption - In Desorption Phase Cooling an Application
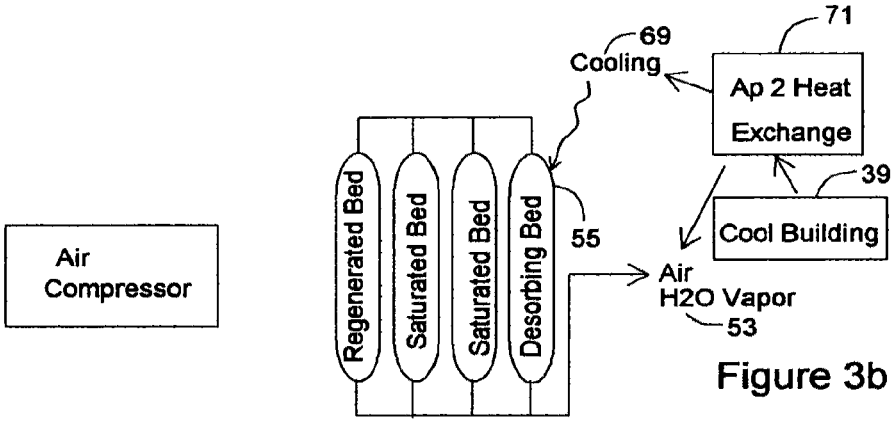
Figure 3b
Figure 3c
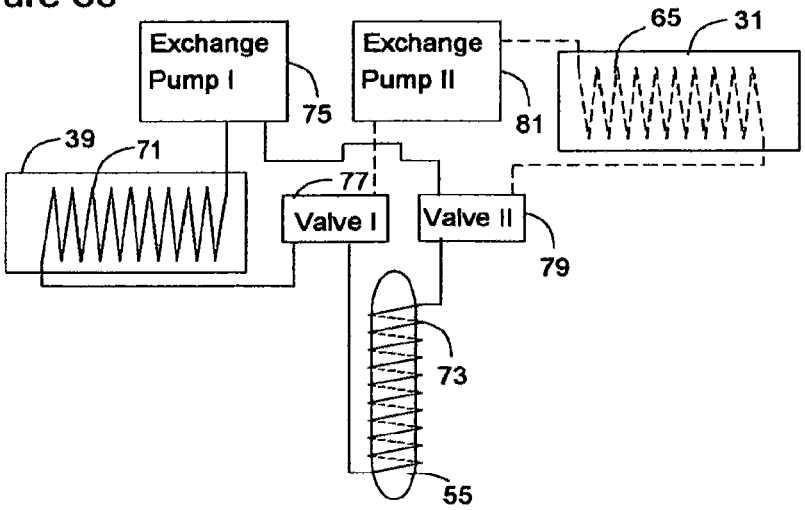

Present Art - Pressure Swing Adsorption Adsorbing and Desorbing

Present Art - Pressure Swing Adsorption Adsorbing and Desorbing

Present Art - Vacuum Swing Adsorption Storing Energy as the Capacity to Heat
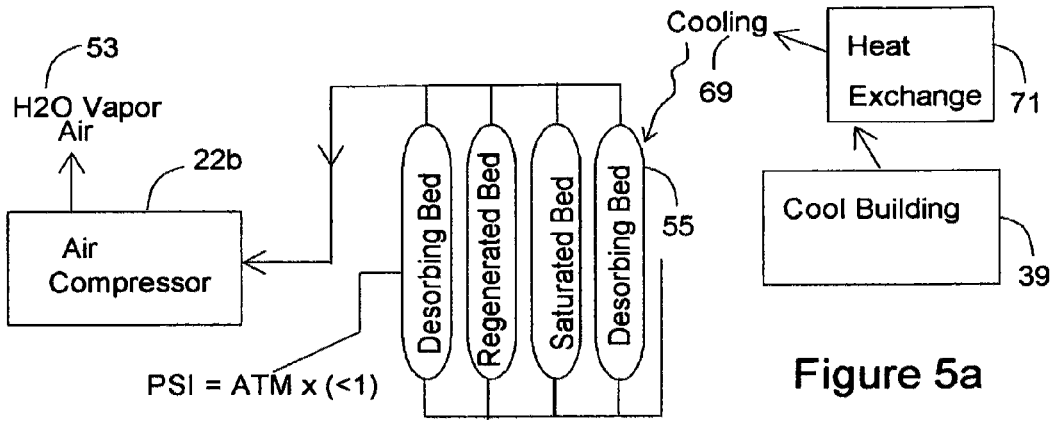
Figure 5a
Figure 5b
Present Art - Vacuum Swing Adsorption - In Adsorption Phase Heating an Application
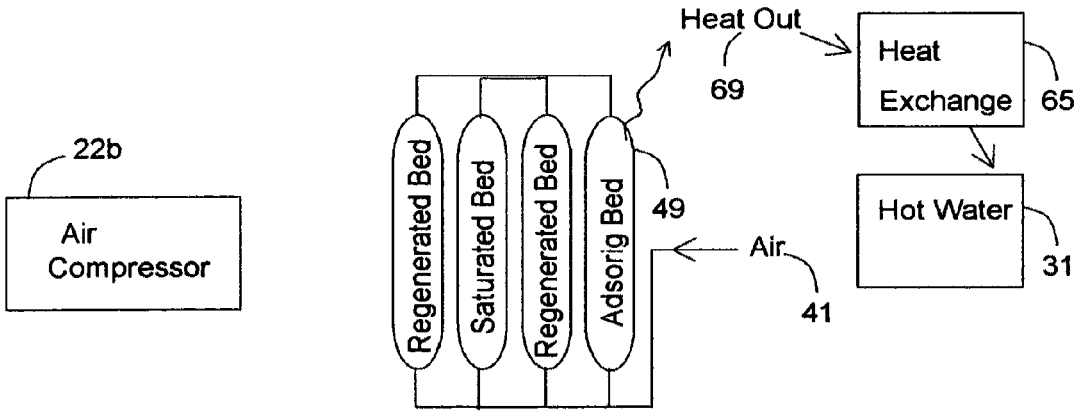

Present Art - Vacuum Swing Adsorption Adsorbing and Desorbing
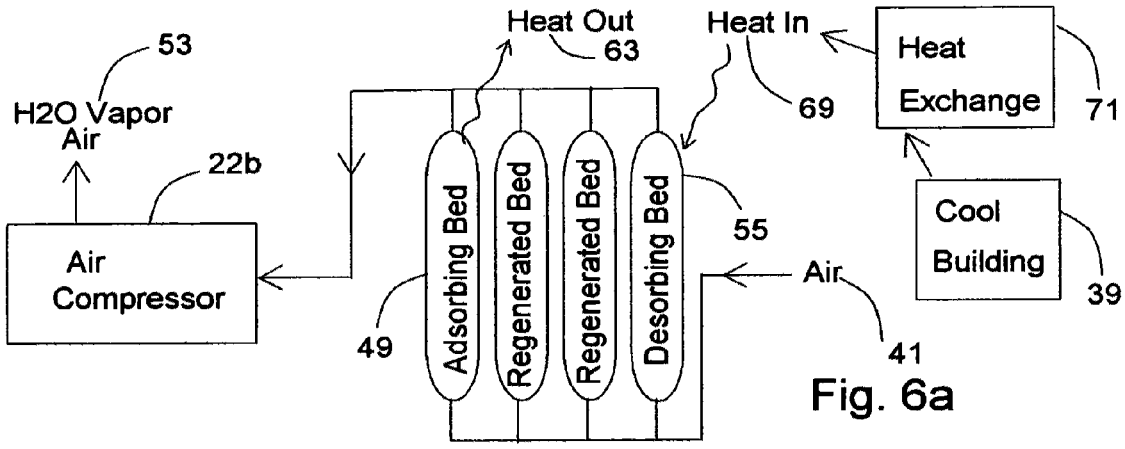
Fig. 6a
Fig. 6b
Present Art - Vacuum Swing Adsorption Adsorbing and Desorbing
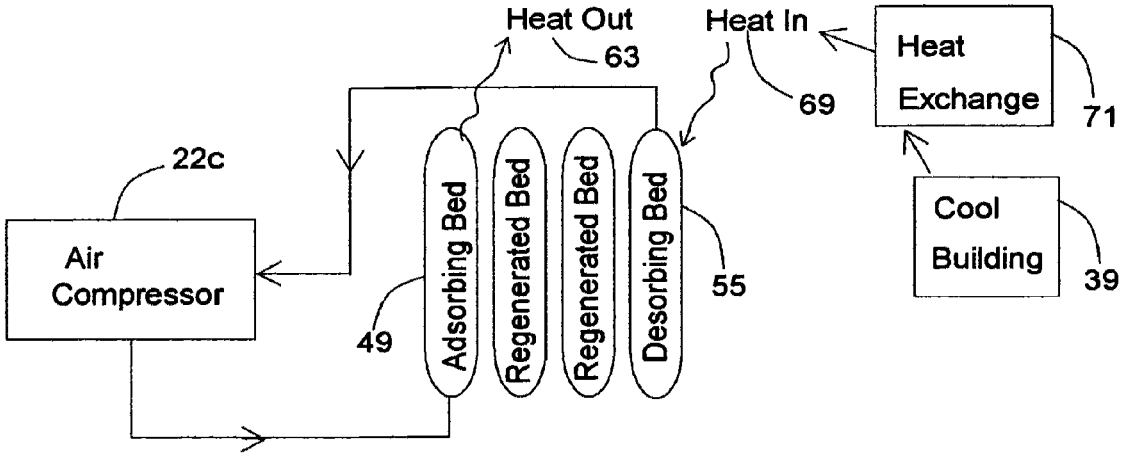

Figure 7a Prior Art - Absorption
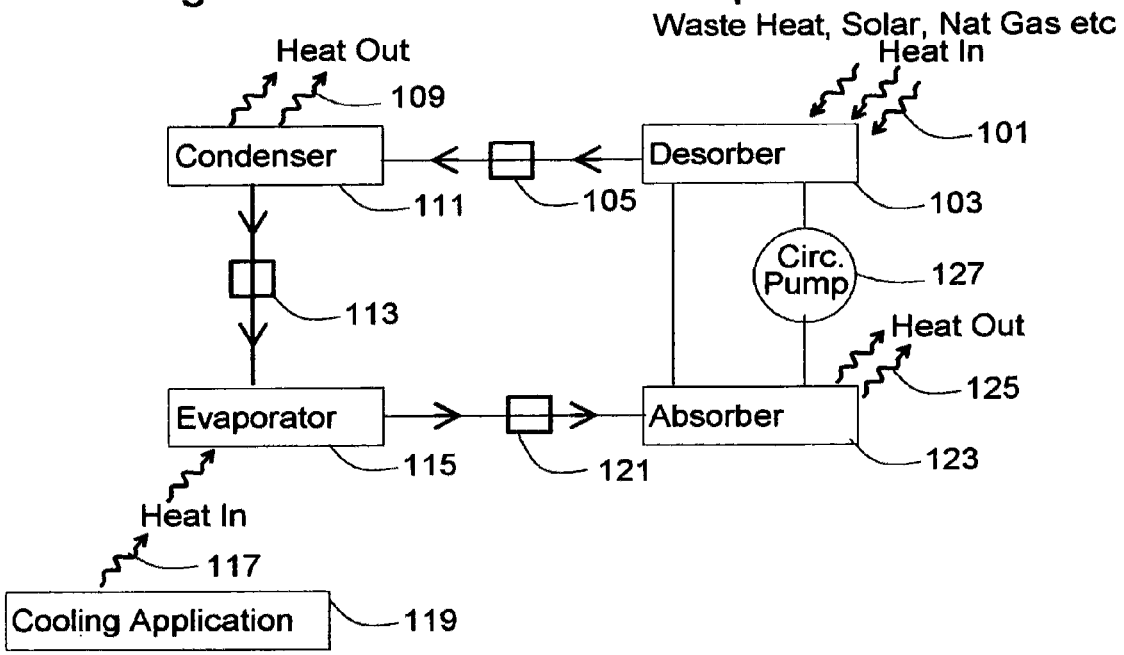
Figure 7b Prior Art - Adsorption Cycle
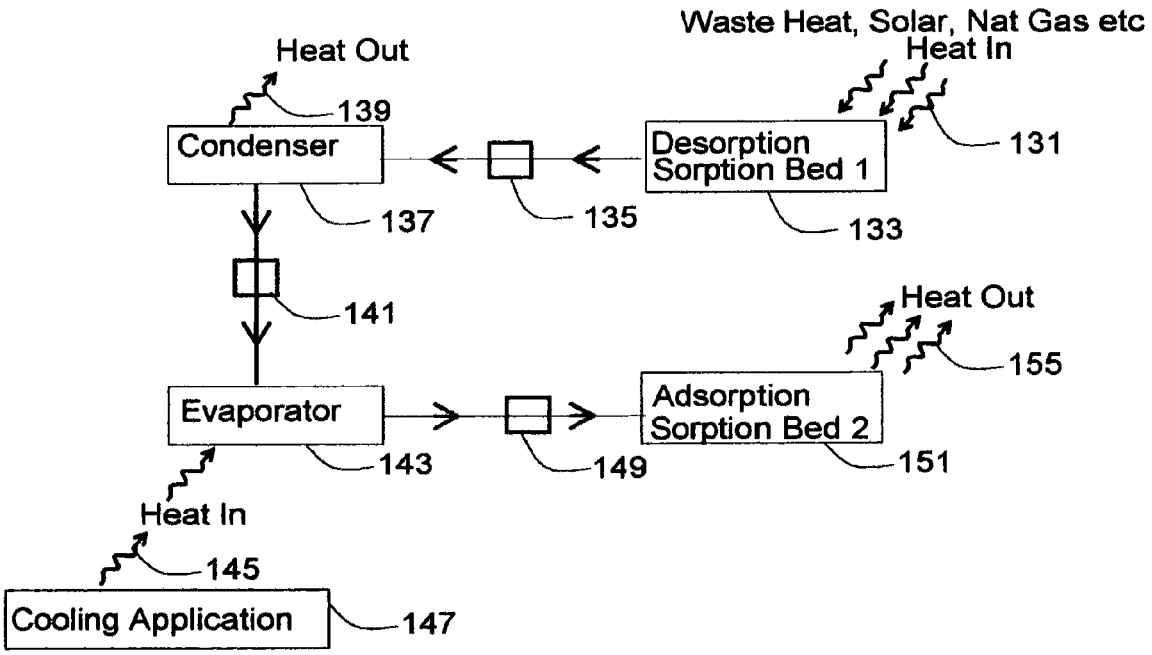

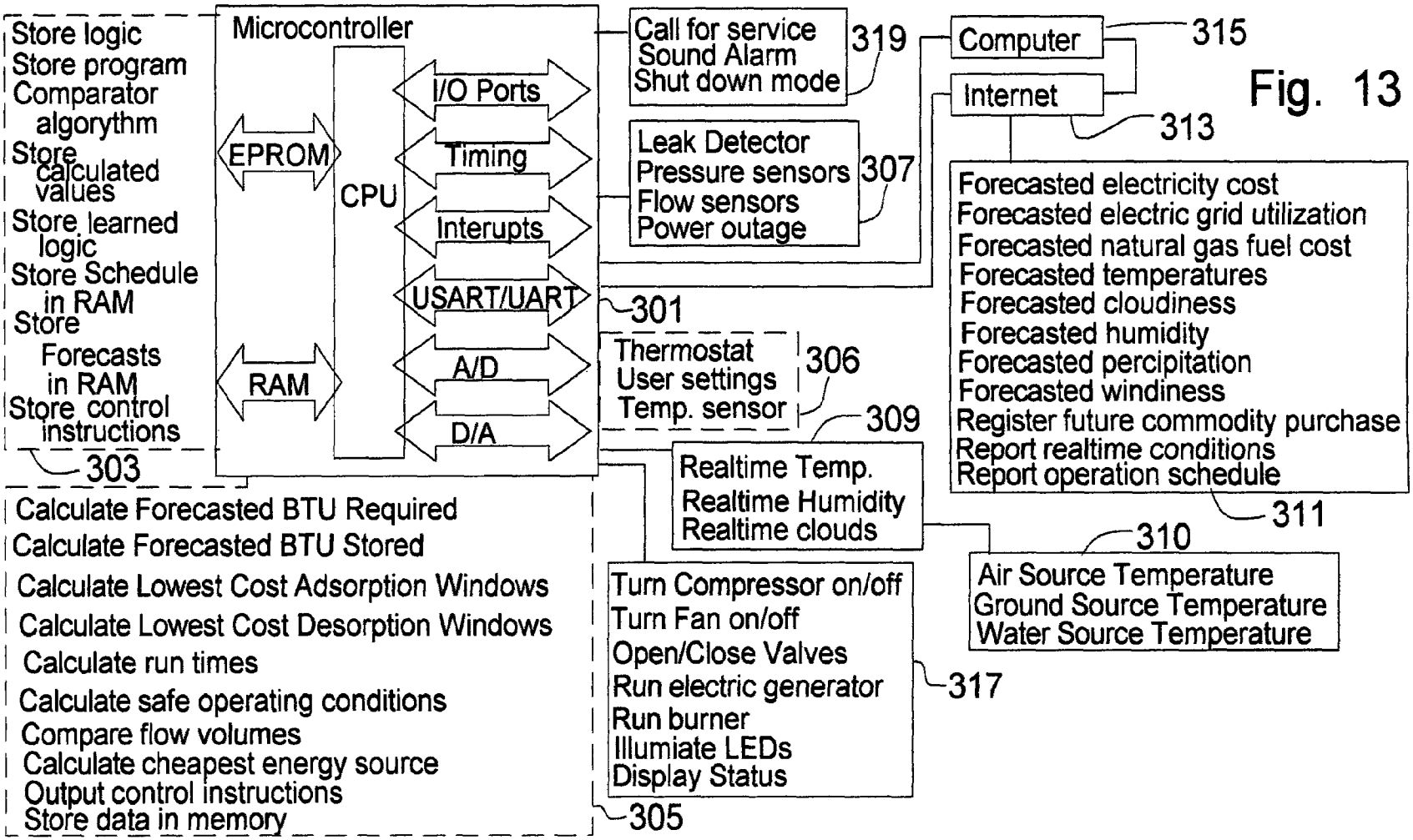
Fig. 13
Computer
315
Internet
313
Forecasted electricity cost
Forecasted electric grid utilization
Forecasted natural gas fuel cost
Forecasted temperatures
Forecasted cloudiness
Forecasted humidity
Forecasted percipitation
Forecasted windiness
Register future commodity purchase
Report realtime conditions
Report operation schedule
311
Air Source Temperature
Ground Source Temperature
Water Source Temperature
310
317
Call for service
Sound Alarm
Shut down mode
319
Leak Detector
Pressure sensors
Flow sensors
Power outage
307
Thermostat
User settings
Temp. sensor
306
309
Realtime Temp.
Realtime Humidity
Realtime clouds
301
Turn Compressor on/off
Turn Fan on/off
Open/Close Valves
Run electric generator
Run burner
Illumiate LEDs
Display Status
305
Microcontroller
I/O Ports
Timing
Interupts
USART/UART
A/D
D/A
CPU
EPROM
RAM
Store logic
Store program
Comparator algorythm
Store Calculated values
Store learned logic
Store Schedule in RAM
Store Forecasts in RAM
Store control instructions
303
Calculate Forecasted BTU Required
Calculate Forecasted BTU Stored
Calculate Lowest Cost Adsorption Windows
Calculate Lowest Cost Desorption Windows
Calculate run times
Calculate safe operating conditions
Compare flow volumes
Calculate cheapest energy source
Output control instructions
Store data in memory

PRESSURE SWING ADSORPTION / DESORPTION HEATING, COOLING, AND ENERGY STORAGE PROCESS AND APPARATUS

RELATED APPLICATIONS

This patent application is a conversion into a full utility patent application of U.S. Provisional Application 61/572,091 filed Jul. 11, 2011 titled "Air Sourced fluid adsorption heating, cooling, energy storage apparatus and process".

This invention is a Continuation In Part of U.S. Provisional Application 61/572,091 filed Jul. 11, 2011, of U.S. patent application Ser. No. 12/217,575 filed on Jul. 7, 2008, now abandoned of U.S. patent application Ser. No. 12/586,784 filed on Sep. 26, 2009, now U.S. Pat. No. 8,209,992 of U.S. patent application Ser. No. 12/653,521 filed on Dec. 15, 2009, now abandoned and of U.S. patent application Ser. No. 12/799,103 filed on Apr. 16, 2010 now abandoned.

BACKGROUND

1. Field of Invention

This invention relates to building heating, cooling, and energy storage systems. More specifically, this invention relates to apparatuses and processes that use pressure swing adsorption and desorption to achieve heating, cooling, and energy storage.

2. Description of Prior Invention

Adsorption is emerging as an important process for separating fluids, heating, cooling, molecule storage, and energy storage. The present invention comprises a pressure swing adsorption (so called "heatless" adsorption) cycle that in a preferred embodiment provides heating, cooling and energy storage in a single adsorption cycle. In a first embodiment, the invention uses an open loop environmental air sourced adsorbate fluid which is adsorbed from air, run through one or more steps, and then released back to the environmental air. In a second embodiment, the invention uses a closed loop adsorbate fluid which is pressure swing adsorbed releasing heat, then pressure swing desorbed absorbing heat. The released heat is applied to a heating application such as heating a building and the absorbed heat is absorbed from an application to be cooled such as a building. Also the adsorption and the desorption processes are selectively separated in time such that a saturated sorption bed provides a stored capacity to cool which is utilized by simply opening a valve; similarly a regenerated sorption bed provides a stored capacity to heat which is utilized simply by opening a valve. For about 100 years, prior art temperature swing adsorption and absorption has been utilized for cooling systems such as adsorption chillers and ammonia absorption chillers. Such systems have the advantage of being relatively simple with few moving parts and being powered by burning fuel, or solar thermal energy, or waste heat energy but have the disadvantage of requiring excessive heat input for desorption and therefore have a low COP efficiency. An example of a water based temperature swing adsorption system including a storage aspect is described in an undated paper "Sorbtion Materials for Application in Solar Heat Energy Storage" by P. Gantenbein et al of the Institute for Solartechnik in Switzerland. The present invention replaces the heat input "temperature swing adsorption" and "temperature swing absorption" driven compression and phase change effect with mechanical energy input "pressure swing adsorption" driven compression and phase change effect. Moreover the prior art cycle resembles a vapor compression cycle with an evaporator, a condenser, and with the desorption process not being directly utilized for cooling an application such as a building. By contrast, the present cycle requires no evaporator, no condenser, and the desorption in the sorption bed is applied directly to a cooling application such as cooling a building. The present cycle driven by mechanical energy input from an electric compressor pump or a renewable wind driven compression pump, with the mechanical energy applied to pressure swing adsorption, or pressure swing desorption, or to both. Very recently researches have demonstrated a pressure swing adsorption process applied to producing chilled water. This demonstration is described in *Chemical Engineering Journal,* #171, (2011) 541-548, Titled "Experimental investigation of a single-bed pressure swing adsorption refrigeration system towards replacement of halogenated refrigerants" by Kumar Anupam et al. It is also described in India Patent Application 1153/KOL/2011 A dated Jan. 9, 2011 and published on Sep. 9, 2011 titled "An Eco-Friendly Mechanism of Cold Production to Combat With Halogenated Refrigerants", invented by Halder Gopinath, and Kumar Anupam. In these documents, CO2 is the adsorbate, activated carbon is the adsorbent, a COP of 3.014 using a pressure swing of 0.1 MPa to 0.5 MPa, cooled water from 26° C. to 4° C. While this illustrates a prior art application of pressure swing adsorption cycle and apparatus utilized for a cooling application, the present invention describes and claims more complex cycles, integration of mechanical energy inputs, multiple adsorption beds, application of pressure swing adsorption to both heating and to cooling applications, achieving heating and cooling applications concurrently, loading one or more beds as a stored capacity to cool, regenerating one or more beds as a stored capacity to heat, using a pressure differentials to passively cool, using a pressure differential to passively heat, maximizing the effective energy storage capacity of sorption beds by inducing an adsorbate tank, a system for leveraging pressure differentials between sorption beds to maximum advantage, integrating pressure swing adsorption heating and cooling with other forms of energy transfer, and a electronic, firmware, software control system to take advantage of these preceding apparatuses, cycles, and advantages.

BRIEF SUMMARY

The present invention is drawn to leveraging pressure swing adsorption to perform a heating function, an energy storage function, and a cooling function. In a first embodiment, the system having the advantage of sourcing an adsorbate from the air and releasing the adsorbate back to the air such that large volumes of adsorbate can form a dense energy storage mechanism while no low density storage of the adsorbate is needed since the adsorbate is stored naturally in the environment. In a second embodiment, the invention uses a closed loop adsorbate fluid such as CO2 which is pressure swing adsorbed releasing heat, then pressure swing desorbed absorbing heat. The released heat is applied to a heating application such as heating a building and the absorbed heat is absorbed from a cooling application such as cooling a building. Also the adsorption and the desorption processes can be separated in time such that a saturated sorption bed provides a stored capacity to cool which is be utilized by simply opening a valve to allow fluid to flow to equalized pressures; similarly a regenerated sorption bed provides a stored capacity to heat which is utilized simply by opening a valve to allow fluid to flow to equalized pressures. Mechanical energy input "pressure swing adsorption" utilizes compression to drive an exothermic adsorption phase change and utilizes decompression to drive an endothermic desorption phase change wherein one or both of these processes is applied directly to respectively heating and/or cooling an application such as a building. Mechanical energy input is achieved by an electric compressor pump or by renewable energy such as wind or wave energy.

OBJECTS AND ADVANTAGES

Accordingly, several objects and advantages of the present invention are apparent.

It is an object of the present invention to provide an energy efficient heating processes. It is an object of the present invention to provide an energy efficient cooling process. It is an object of the present invention to store energy in an adsorbed or loaded bed state for subsequent use in a passive cooling application controlled by a value allowing fluid to flow to pressure equalization. It is an object of the present invention to store energy in a desorbed or regenerated bed state for subsequent use in a passive heating application controlled by a value allowing fluid to flow to pressure equalization. It is an object of the present invention to provide a cycle that includes a single mechanical energy input step to achieve a pressure change that drives an adsorptive heating of an application step, an energy storage step, and a desorptive cooling of an application step. It is an advantage of the present invention that in the first embodiment air is the source of the adsorbate molecule. It is an advantage of the present invention in the first embodiment that once the adsorbate molecule completes a cycle it is released back to the air. It is an advantage of the present invention that no condenser is needed. It is an advantage of the present invention that no evaporator is needed. It is an advantage of the present invention that heat from adsorption can be applied directly to an application requiring heat such as a building. It is an advantage of the present invention that heat required for desorption can be extracted directly to an application requiring cooling such as a building. It is an advantage of the present invention that a higher COP is achievable compared to prior art temperature swing adsorption cycles.

The present application describes novel, unobvious and valuable pressure swing adsorption and pressure swing desorption cycles, integration of mechanical energy inputs, multiple adsorption beds, application of pressure swing adsorption to both heating and to cooling applications, achieving heating and cooling applications concurrently, loading one or more beds as a stored capacity to cool with no concurrent mechanical work input, regenerating one or more beds as a stored capacity to heat with no concurrent mechanical work input, using pressure differentials to passively cool, using pressure differentials to passively heat, maximizing the effective energy storage capacity of sorption beds by inducing an adsorbate storage means, a system for leveraging pressure differentials between sorption beds to maximum advantage, integrating pressure swing adsorption heating and cooling with other forms of energy transfer, and a electronic, firmware, software control system to take advantage of these preceding apparatuses, cycles, and advantages.

Further objects and advantages will become apparent from the enclosed figures and specifications.

DRAWING FIGURES

Figure 1A:
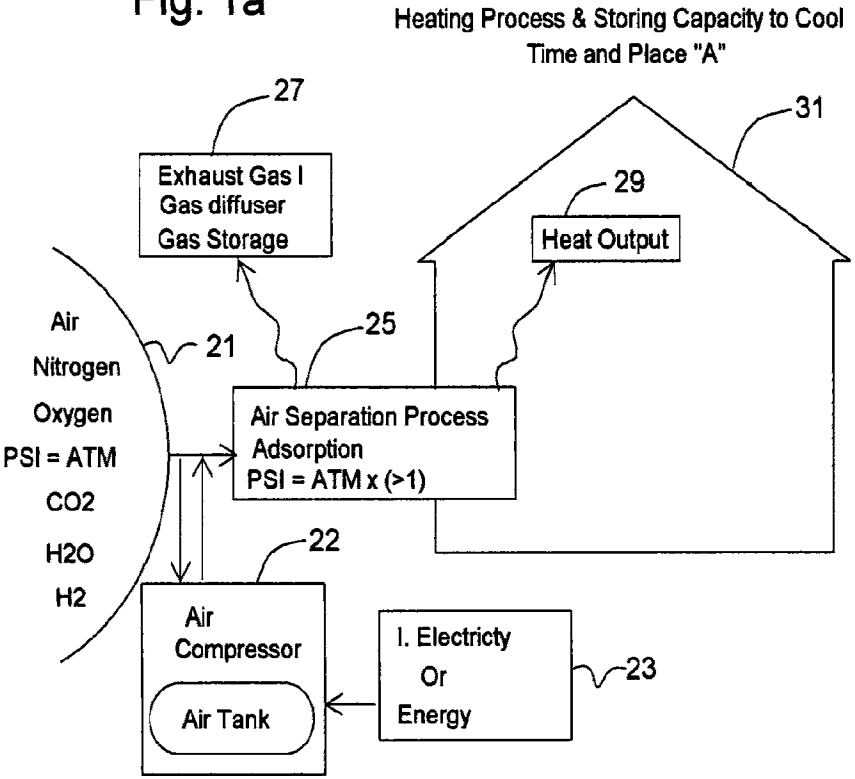

FIG. 1*a* illustrates adsorption heating and energy storage steps of the present invention.

FIG. 1*b* illustrates desorption cooling step the present invention.

Figure 2:
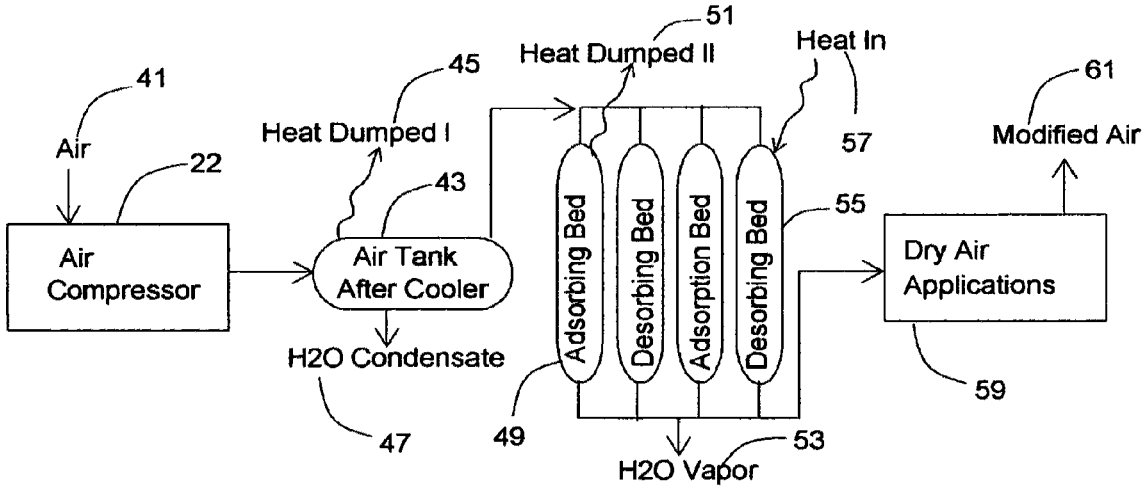

FIG. 2 is an illustration of a prior art commercial off the shelf pressure swing adsorption heatless air dryer.

FIG. 3*a* illustrates a GH-800 modified to perform air sourced adsorbate non-concurrent adsorption, and desorption processes for the purpose of optimizing heating, cooling, and energy storage applications.

FIG. 3*b* illustrates the modified GH-800 of FIG. 3*a*.

FIG. 3*c* illustrates a heat exchange system for temperature exchange between the GH-800 and the heating and cooling applications for use in FIGS. 3*a* through 6*b*.

Figure 4A:
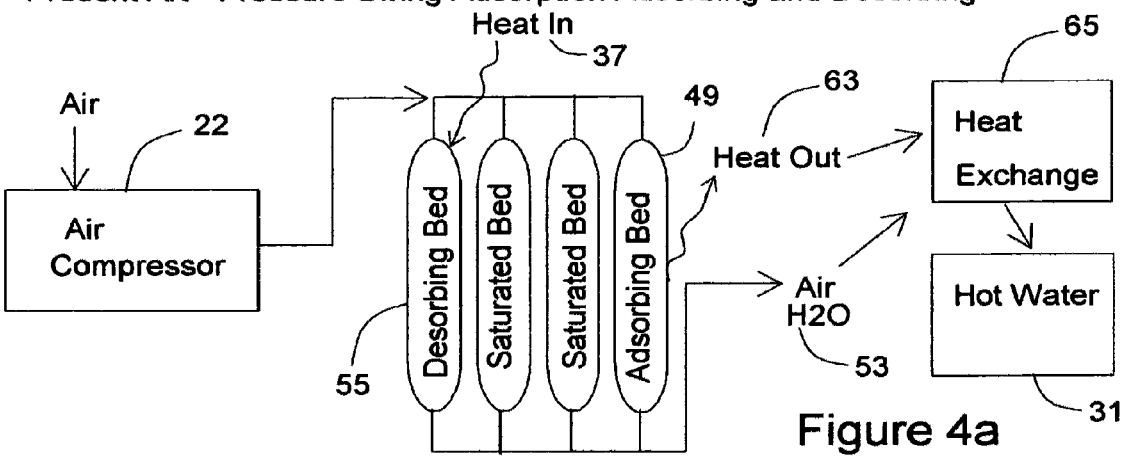

FIG. 4*a* illustrates the GH-800 modified of FIGS. 3*a* through 3*c* performing concurrent adsorption, and desorption processes.

Figure 4B:
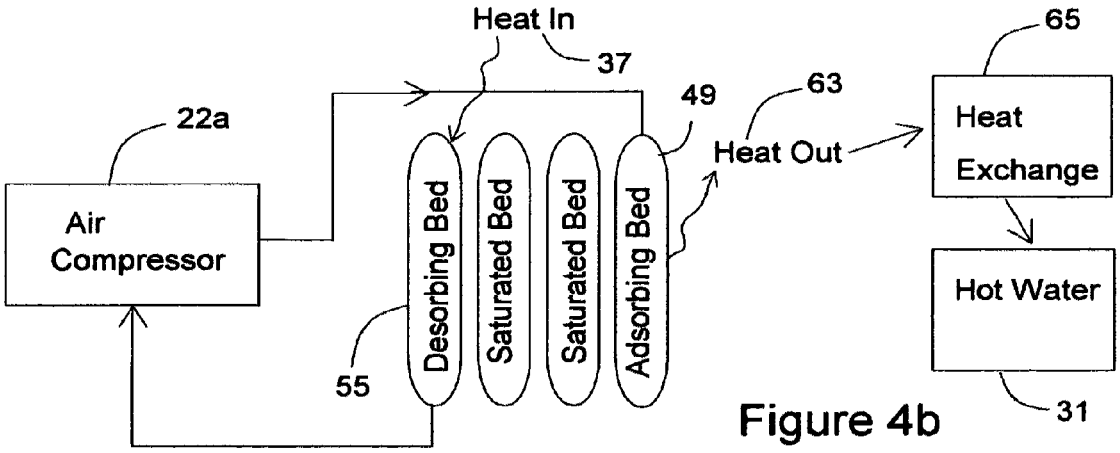

FIG. 4*b* illustrates the GH-800 modified of FIG. 4*a* performing an alternate process flow including concurrent adsorption, and desorption processes.

FIGS. 5*a*, 5*b*, 6A, and 6*b* illustrate the GH-800 modified as above operating on a vacuum swing adsorption cycle.

FIG. 7*a* illustrates apparatus and operating cycle of a prior art absorption system.

FIG. 7*b* illustrates the apparatus and operating cycle of a prior art adsorption system.

Figure 8A:
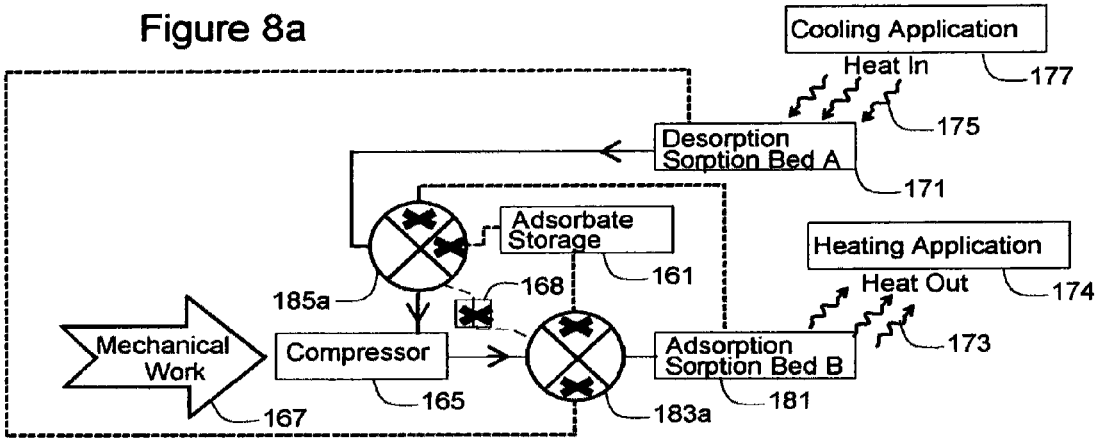

FIG. 8*a* illustrates the apparatus, cycle, and processes of a two bed pressure swing adsorption system modified for the purposes of achieving a temperature swing to perform heating and cooling applications.

Figure 8B:
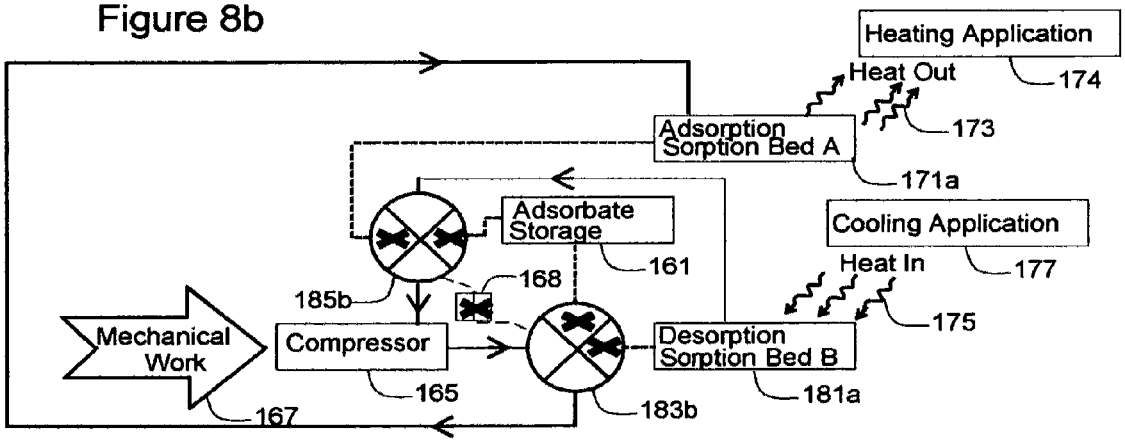

FIG. 8*b* illustrates the apparatus of FIG. 8*a* controllably switched to operate in a reverse flow.

Figure 9A:
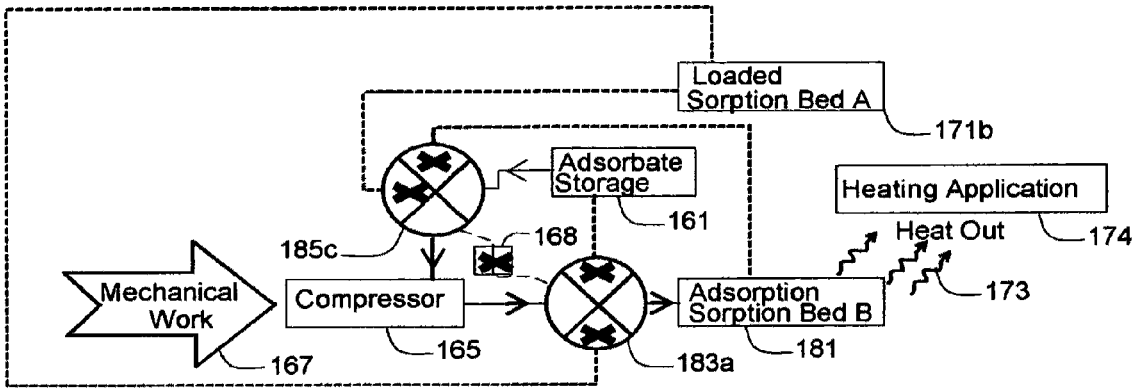

FIG. 9*a* illustrates the apparatus of FIGS. 8*a* and 8*b* operationally integrated with the adsorbate storage 161.

Figure 9B:
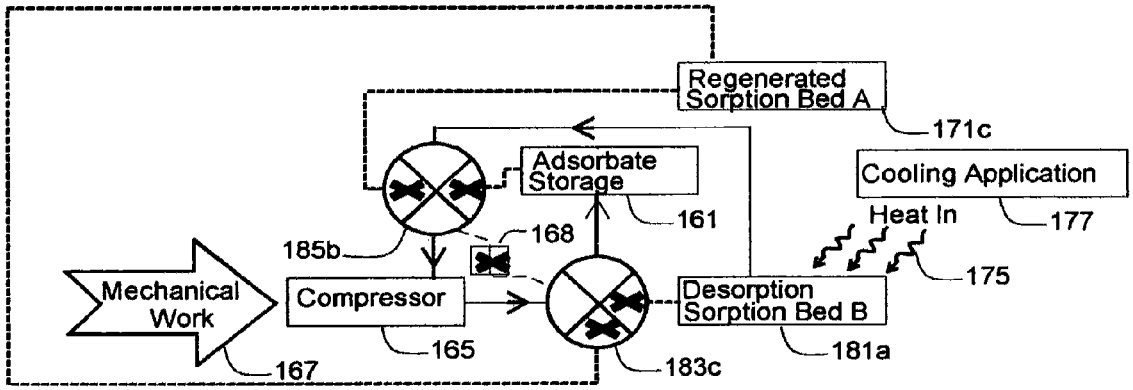

FIG. 9*b* illustrates the apparatus of FIG. 9*a* operationally integrated with the adsorbate storage 161.

Figure 10A:
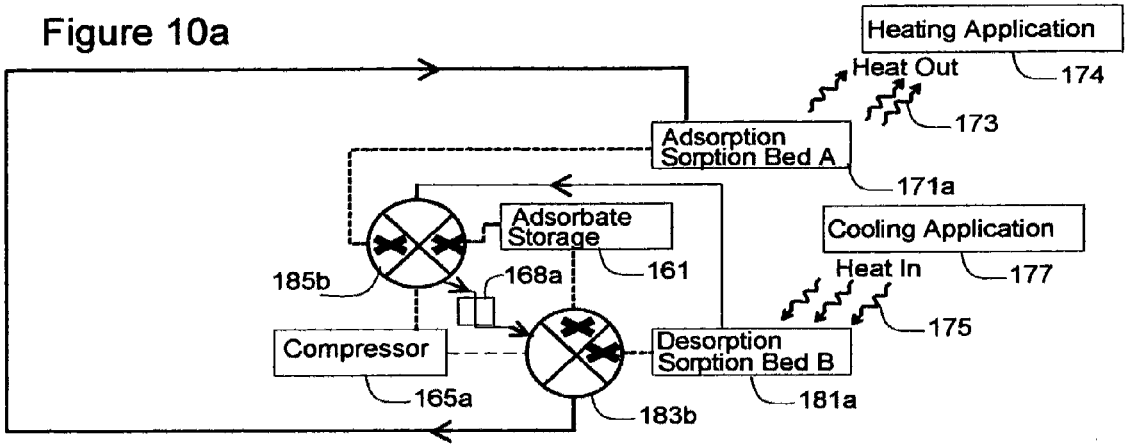

FIG. 10*a* is the system of FIG. 9*b* switched to perform heating and cooling applications without concurrent mechanical work input.

Figure 10B:
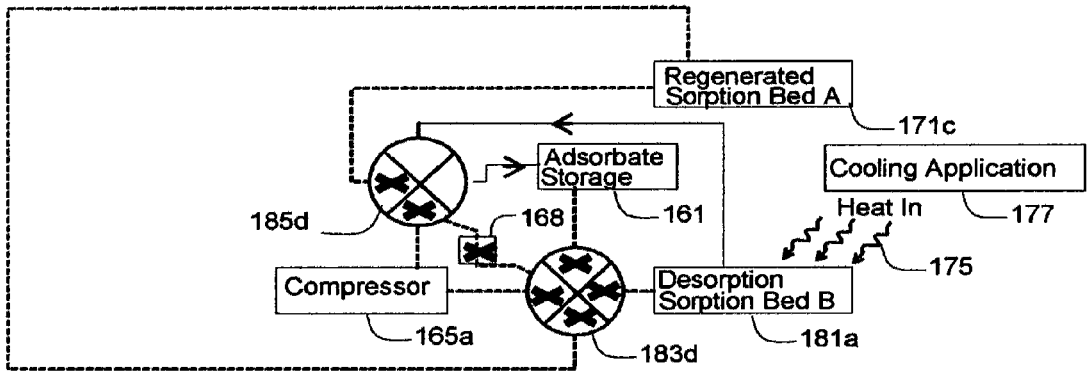

FIG. 10*b* is the system of FIG. 10*a* with a cooling function performed from the stored pressure differential between one sorption bed and the adsorbate storage with no concurrent mechanical work needed on the CO2 adsorbate working fluid.

Figure 10C:
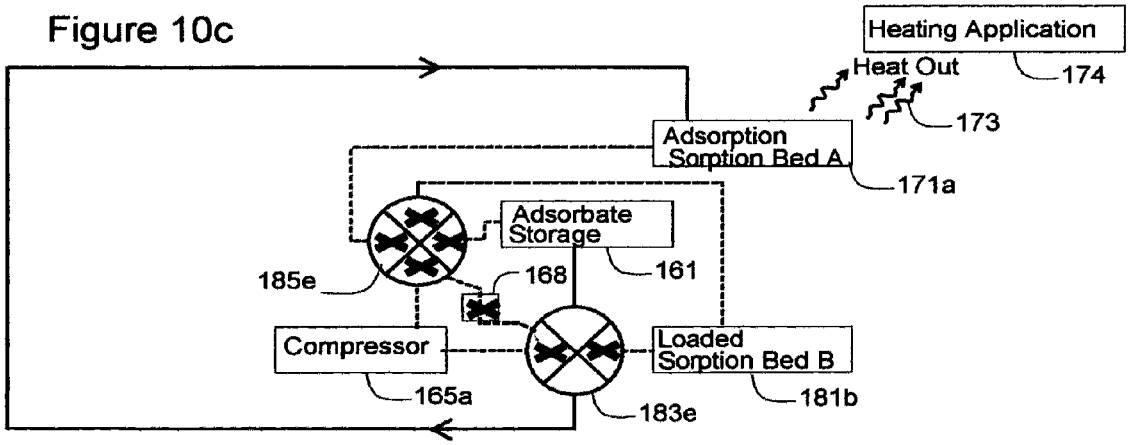

FIG. 10*c* is the system of FIG. 10*b* switched to perform heating from stored adsorbate.

Figure 11B:
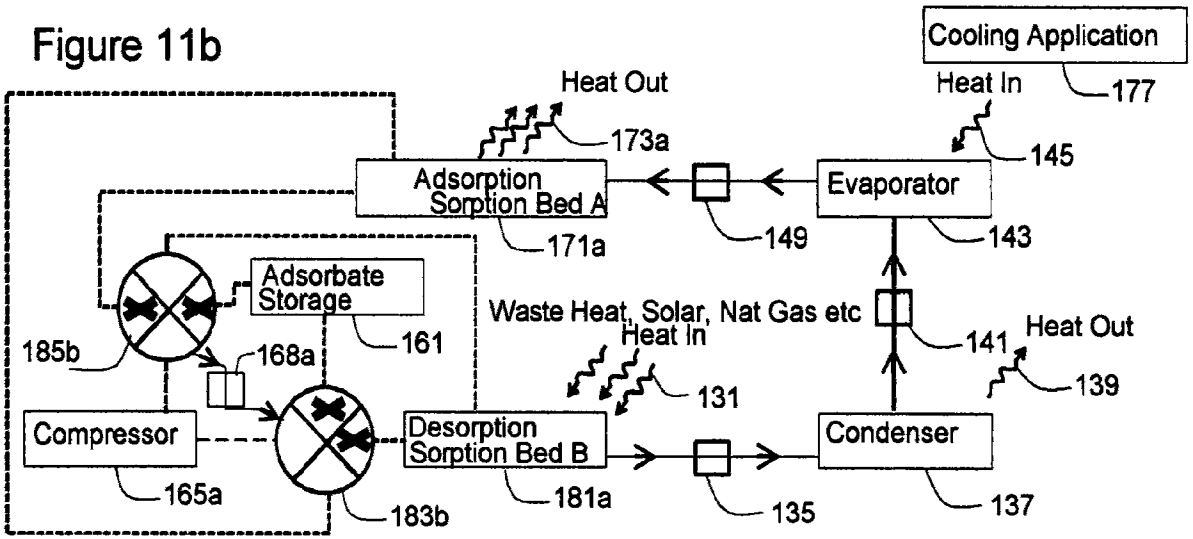
Figure 11A:
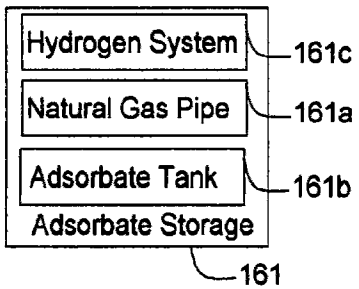

FIG. 11*a* illustrates examples of some adsorbate storage systems.

FIG. 11*b* illustrates the present invention integrated with the prior adsorption system of FIG. 7*b*.

Figure 12B:
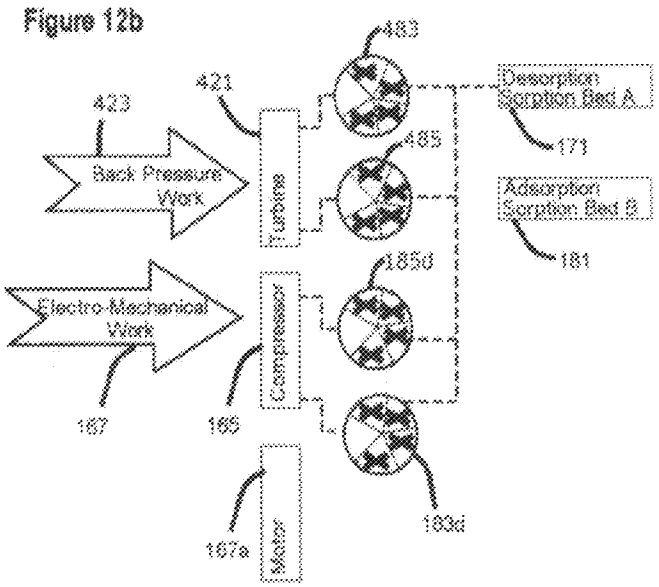
Figure 12A:
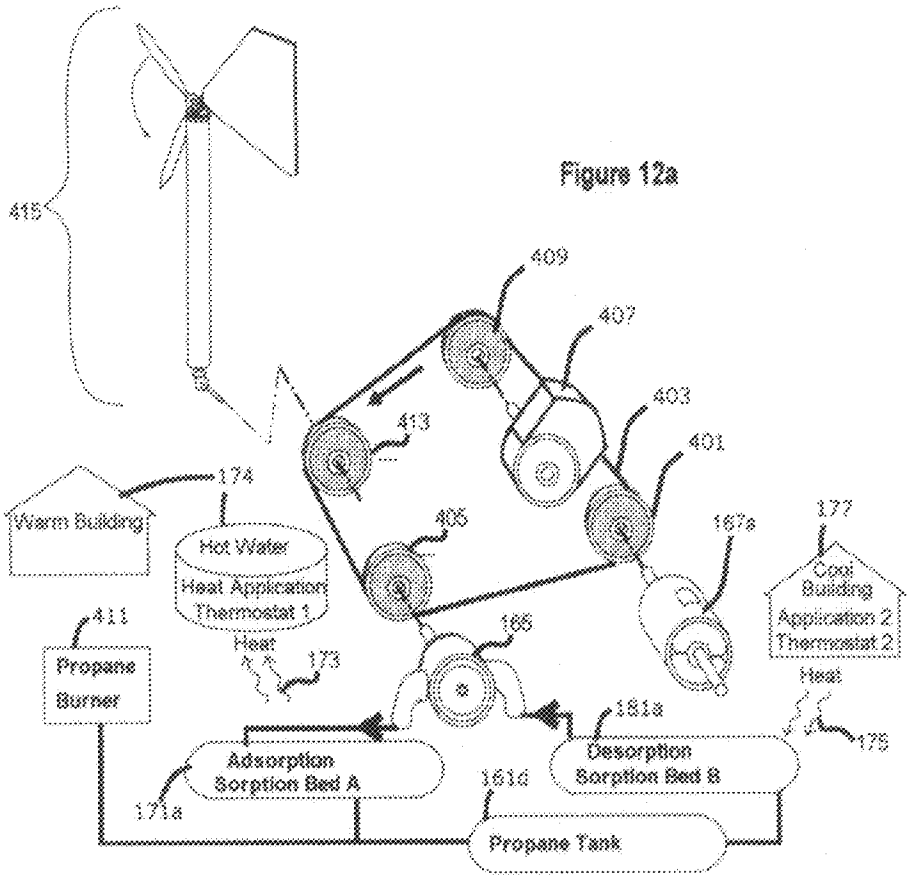

FIG. 12*a* illustrates integration of the present art pressure swing adsorption system with an electric, wind, and propane energy transformation system that accepts a variety of energy inputs and transforms them to a variety of energy outputs.

FIG. 12*b* illustrates use of the pressures differential described previously as a mechanism to generate electricity.

FIG. 13 illustrates the electronic, firmware, and software required to operate the apparatus, processes, and cycles described herein.

DETAILED DESCRIPTION OF THE INVENTION

First Embodiment

Open System

FIG. 1*a* illustrates adsorption heating and energy storage steps of the present invention. Environmentally available fluids 21 are drawn from the environment into the system by an air compressor 22 which is powered by an energy input 23 such as electricity or renewable energy such as solar energy or wind mechanical energy. The air compressor 22 compresses the environmentally available fluids which are then directed into an adsorption process 25 where adsorption of one or more molecule species (as later discussed) occurs. The air compressor operated in response to a control signal from a thermostat set to heat 24. The adsorption process generally favors specific molecule species over other molecule species with the later molecules comprising an exhaust gas I 27 which is ejected from the system. An adsorption heat output 29 is used to perform a heating application 31 such as heating a building or heating water. Note that as later discussed, a plurality of adsorption beds are preferred and once a specific adsorption bed is saturated, it effectively comprises a stored energy in the form of a stored capacity to cool utilized in FIG. 1*b*. Two examples of environmentally available fluids 21 comprise air and water each of which can be drawn into an adsorption system and separated into one or more adsorbates. In ensuing diagrams for the first embodiment H2O vapor extracted from air is the example adsorbate but the art herein can be used for a wide range of adsorbates including carbon dioxide, nitrogen, hydrogen, oxygen, (CO2, N2, H2, O2) and others (this is not an exhaustive list). Many adsorbents utilized in adsorption processes are known and can be utilized herein examples include activated silica gel, zeolite, activated carbon, hydrotalcite, activated alumina, MgCl2, MgSo4, metal oxides, and metal hydrides (this is not an exhaustive list). Each adsorbent has affinity for one or more adsorbates, and will attract and retain the adsorbates as a function of pressure. Adsorption is used extensively in commercial gas separation processes. Extensive work in the area of improving adsorption efficiency and adsorbate storage density is ongoing mainly due to interest in high density hydrogen storage for use in transportation and due to interest in carbon dioxide and other gas sequestration and diversion from smoke stacks and industrial processes. Commercial off the shelf water vapor pressure swing adsorption "heatless" air drying systems are available from PSB Industries, Kahn & Company Inc., and other suppliers, some using activated silica gel as the adsorbent. Commercial off the shelf CO2 pressure swing adsorption air drying systems are available from Nano-Purification Solutions and other suppliers. Innovative Gas Systems and others supply commercial off the shelf nitrogen separator that separate nitrogen from air streams using pressure swing adsorption and carbon molecular sieves. Energy Conversion Devices has done much work in advancing hydrogen storage and is a supplier of systems utilizing adsorption cycles and of underlying intellectual property. Suppliers of the air compressor 22 are well known and abundant. The adsorption process 25 is performed in a plurality of adsorption beds that attract and retain targeted molecules from the air more densely as a function of increased pressure and less densely as a function of decreased pressure, thus the swing in pressure from low to high to low is a means of controlling adsorbate density and the swing in adsorbate density corresponds to a swing in temperature within sorption beds. As pressure increases, adsorption increases, and heat of adsorption is released to heat an application, and as pressure decreases desorption increases, and heat of desorption is is absorbed to cool an application. The adsorption process 25 is performed at a rate controlled by the thermostat set to heat 24 that controllably causes the pressure in the adsorption bed to controllably increase to achieve and maintain a desired warm temperature in the heating application 31. As will be discussed in FIGS. 3*a* through 4*b*, mechanical work can be done by a pump to change pressure in the adsorption bed to be above 1 ATM (energy storage in the form of a stored capacity to cool) whereby through the opening of a desorption valve 34 the pressure can subsequently be passively depressurized to 1 ATM and in the process perform a passive cooling function. Alternately, such as in FIGS. 4*b* through 6*b*, mechanical work can be done by a pump to change pressure in the adsorption bed to be below 1 ATM (energy storage in the form of a stored capacity to heat) whereby through the opening of a valve the pressure can later passively repressurize to 1 ATM and in the process perform a heating function. In today's world, energy storage is increasingly important since intermittent energy sources such as wind and solar often need to be stored when they are abundant for use during times when they are scare. The system herein comprising an energy storage means as described herein and further to the prior applications for which this application is a continuation in part.

FIG. 1*b* illustrates desorption cooling of the present invention. While FIG. 1*a* described the steps relating to adsorption drawn to performing a heating application and whereby mechanical energy from the air compressor drives a pressure swing to facilitate an adsorption swing and a temperature swing, the process of FIG. 1*a* is stopped there such that at the end of the FIG. 1*a* process, a pressure within the adsorption bed in excess of 1 ATM remains along with the adsorbate. The process of FIG. 1*a* in effect leaves the adsorption bed as an energy storage vessel that can be utilized passively to perform a cooling process as described in FIG. 1*b* as follows. A desorption process 33 is performed by throttling the desorption valve 34 controlled by a thermostat set to cool 24*a* that controllably causes the pressure in the adsorption bed of FIG. 1*a* to controllably drop to achieve and maintain a desired cool temperature in a cooling application 39 such as a climate controlled building. As an exhaust gas II 35 is released, the pressure drops, desorption occurs, causing a temperature swing and requiring a heat input 37 which is used to perform cooling of the cooling application 39. Thus in FIG. 1*a* at a first time a first application was heated by a thermostat controlled adsorption process and as in FIG. 1*b*, at a second time, a second application was cooled by a thermostat controlled desorption process. Ideally where heating and cooling processes are in reasonably close physical or temporary proximity, a full cycle comprises a single mechanical energy input utilized to perform in sequence an adsorption heating process, an energy storage process, and a desorption cooling process. An example of such applications as illustrated in FIGS. 3*a* through 6*b* is residential water heating and residence building cooling at a single residence. Another example where heating and cooling requirements are in close physical and temporal proximity is a meat processing plant where surfaces must be cleaned with hot water and where meat refrigeration is also required. In such a case the adsorption process heats the water and the desorption process cools the refrigerated space. However in many applications the heating and cooling requirements are not well matched in which case only the heating side or the cooling side of the adsorption/desorption cycle will be applied to an application with the non-applied process exchanging heat to or from a heat sink or heat source such as air or the ground or water. For example in hot climates where solar energy is available and much cooling is required, solar powered adsorption of FIG. 1*a* can be practiced where the adsorption heat output is dumped into the air, water, or a ground source, the solar energy is then stored as a stored capacity to cool. Desorption application cooling can be done concurrently when the sun is still shinning or subsequently when the sun has set to cool a building in a 24 hour cycle. In a gas separation process, often two desorption beds are used. When the present invention is supporting both heating applications, cooling applications and energy storage as described herein, four or more beds are recommended such that at least one bed can be adsorbing, one bed can be desorbing, one bed can be regenerated (ready for adsorbing), and one bed can be saturated (ready for desorbing). This ensures that heating and cooling applications can be supported at any given point in time. Where energy storage such as solar energy storage and wind energy storage is a large value, more than four adsorption cylinders are recommended to maximize the energy storage capacity. Using multiple adsorption/desorption beds as later discussed, adsorption and desorption processes can be performed concurrently as well.

It should be noted that, depending upon an adsorbate's intrinsic economic value (such as hydrogen's economic value as a fuel or electricity source), or their value in performing a separate process (such as vapor compression heating and cooling), once the adsorbed molecules or the exhausted molecules are separated from the air stream, they can be collected and stored for sale or subsequent use in another process. For example the present application is a continuation in part of U.S. patent application Ser. No. 12/217,575, ALDEN which is included herein by reference and cites uses of hydrogen for energy and nitrogen and CO2 as compressible refrigerant working fluids. Such upstream or down stream processes can be integrated with the art herein.

FIG. 2 is an illustration of a prior art commercial off the shelf pressure swing adsorption heatless air dryer. This prior art is described herein as a contrast between existing systems that perform adsorption on air streams. It is modified to demonstrate the present invention as described in FIGS. 3*a* through 6*b*. The system of FIG. 2 is a GH-800 heatless regenerative compressed air dryer supplied by PSB Industries Inc. for the purpose of removing H2O vapor from a compressed air stream. It utilizes activated silica gel as the adsorbent in at least two adsorption beds (four beds are illustrated herein). An air 41 input is drawn into the system by the air compressor 22 then directed to an after cooler 43 for the purpose of cooling down and removing moisture whereby dumped heat I 45 and H2O condensate 47 are ejected from the process. By contrast, the purpose of the present invention is to maximize the adsorption/desorption effect thus the present invention illustrated in FIGS. 3*a* through 6*b* eliminates the after cooler from the cycle. The GH-800 includes an air intake manifold and valve system and an air exhaust manifold and valve system that in FIG. 2 and subsequent illustrations are represented by connecting lines and arrows. The GH-800 also includes a series of filters to remove oil and particulates at various fluid flow stages. The GH-800 also includes a software and electronic control system to open and close valves to direct flow through the manifolds to ensure that a constant output dry modified air 61 flow is achieved while adsorption is performed in one or more beds and concurrently desorption is performed in one or more beds. It should be understood that the filters, valves, and controls of the GH-800 are required although they are not specifically illustrated herein. Similarly, the modified GH-800 of FIGS. 3*a* through 6*b* requires filters, valves, and controls that are not specifically illustrated, one modification being the sequence of valve openings and closings is modified to optimize the GH-800's performance as a pressure swing heating, energy storage, and cooling apparatus of the present invention.

In operation, an air intake valve opens to an adsorbing bed 49 which receives air from the after cooler 43 water vapor is adsorbed in the silica get adsorption bed while the exhaust valve for the adsorbing bed 49 is closed (or throttles the output flow to maintain an elevated pressure) while the bed cycles through the adsorption process. Each of the adsorption beds is contained within a metal cylinder designed to operate through a pressure swing from 1 ATM to 150 PSI. For five minutes, as the adsorption process is performed, dry air is directed from the adsorption bed to dry air applications 59. An example of an application requiring dry air is compressed air tools; removing H2O vapor from the air stream that drives compressed air driven tools increases their longevity.

During the five minute adsorption, the 475 pounds of adsorbent in a single bed adsorbs approximately 1.5 pounds of H2O vapor. The silica gel and other materials hold H2O and other adsorbates at much greater density than is used for the GH-800 dry air application, every pound of activated silica gel is capable of adsorbing approximately 0.4 pounds of H2O vapor; a tradeoff exists between increasing the density of the adsorbate adsorbed and an increasing difficulty dislodging the adsorbate from the adsorption bed (a diminishing return on investment). It is estimated that the optimal balance for the present invention is below 0.4 pounds water/pound of activated silica gel. Heat of water adsorption is approximately 40 kJ/mol. Assuming 40 kj/mol, a GH-800 cylinder holding 0.4 pounds H2O/pound of activated silica gel stores 954 BTU/pound capacity to cool compared to ice storage systems which store 144 BTU/pound capacity to cool in ice. The below modified GH-800 operating optimally is estimated to store between 20,000 and 40,000 BTU/Ft3 for activated silicon gel which compares favorably to ice storage systems storing 9000 BTU/Ft3. Under these conditions the stored capacity to cool within a single GH-800 bed equates to approximately 1 day of summer cooling for a 6 ton HVAC system.

A heat dumped II 51 comprises the heat of adsorption which is typically dumped into the air or another heat sink generally not performing any useful heating function. During the five minute absorption, the metal cylinder containing the adsorption bed 49 undergoes a temperature swing of approximately 10° F. above ambient temperature. When the five minute cycle is complete, an exhaust valve is opened and the adsorbing bed 49 is vented to a lower pressure (such as 1 ATM) and H2O vapor 53 is expelled from the system the adsorbing bed being regenerated in the process. Concurrent with the operation of the adsorbing bed 49, the GH-800 concurrently has one or more cylinders with adsorption beds undergoing the desorption process such as desorbing bed 55 which has its intake valve to the after cooler 43 generally closed or throttled and its lower exhaust valve generally open such that its pressure is brought down to a lower pressure (such as 1 ATM). The desorbing bed 55 requires heat in 57 which is generally extracted from ambient air (not performing a useful cooling function) and the cylinder containing the desorbing bed 55 undergoes a temperature swing of approximately 10° F. below ambient temperature. Thus the prior art comprises an open loop, environmentally sourced adsorbate, pressure swing adsorption process for the purpose of separating a fluid utilizing a concurrent adsorption and desorption cycle. In this example the thermal swing is not utilized for heating and or cooling functions, no heat exchangers are provided for that purpose. No mechanism for storing energy is provided. By contrast the present invention described in FIGS. 1*a*, 1*b*, and 3*a* through 6*b* comprises an open loop (open loop in a preferred embodiment or a closed loop in an alternate embodiment), environmentally sourced adsorbate, pressure swing adsorption process for the purpose of providing a heating process, energy storage means, and a cooling process in a preferred embodiment leveraging non-concurrent adsorption and desorption steps.

FIG. 3*a* illustrates a GH-800 modified to perform air sourced adsorbate non-current adsorption and desorption processes for the purpose of optimizing heating, cooling, and energy storage applications. Compared to the commercially off the shelf GH-800 of FIG. 2, modifications include elimination of the after cooler 43, timing of opening, throttling, and closing of bed intake valves, timing of the opening, throttling, and closing of the bed exhaust valves, and the underlying software instructions and mechanisms that control timing and valve actuation, also a heat exchange mechanism is added as in FIG. 3*c* to capture and apply heat from adsorption to the heating application and to extract heat for desorption from the cooling application, as part of a electronic and software control system, a thermostat is provided at the heating application to signal when the application needs more heat (accordingly an adsorption process is commenced or increased), and as part of an electronic and software control system, a thermostat is provided at the cooling application to signal when the application needs more cooling (accordingly a desorption process is commenced or increased). Also in operation, the modified GH-800 of FIG. 3*a* operates to store energy in the form of the stored capacity to cool. Stored energy is at its maximum when all cylinders contain their pressure upper limit and beds that are saturated with adsorbed H2O adsorbate. This is so since each cylinder then comprises a capacity to passively cool simply by throttling its exhaust valve to controllably swing the pressure in the cylinder to 1 ATM of pressure. Conversely, in operation, the modified GH-800 of FIG. 5*a* operates to store energy in the form of the stored capacity to heat. Stored energy is at its maximum when all cylinders contain their pressure lower limit (below 1 ATM) and beds that are regenerated (with as little adsorbed H2O adsorbate as possible). This is so since each cylinder then comprises a capacity to passively heat simply by controllably throttling its intake valve to swing the cylinder pressure up to 1 ATM. Note, the term "saturated" or "loaded" herein is not meant to mean filled to its 100% saturation equilibrium point. "Saturation" or "loaded" herein means filled to a defined percentage optimal for energy efficiency. Similarly, the term "regenerated" herein is not meant to mean freed of all adsorbate. "Regenerated" herein means filled to a defined minimum percentage optimal for energy efficiency. As described above filling an adsorption bed above a specific percentage can begin to have a negative incremental benefit and also desorbing the sorption bed below a specific percentage has negative incremental benefits.

In operation the air 41 is drawn in from the atmosphere by the air compressor 22 and directed through the intake manifold to an open intake valve into adsorbing bed 49. An exhaust valve for the cylinder containing the adsorbing bed 49 can be either kept closed or throttled to achieve optimal adsorption or optimal thermal output performance. A heat out 63 is captured by an application A heat exchange 65 which in turn directs the heat to the heating application 31 which in the case of a building, is heating hot water. The heat exchange interface with the modified GH-800 is further described in FIG. 3*c*. The exhaust from the adsorbing beds may comprise a warm air 67 that can be directed to and used in the application heating process.

Note that when the heating function is performed (and no cooling function is needed) beds are transformed from a regenerated state to a saturated state, no beds need to be in a desorbing state unless as in FIG. 4*a* all beds are already saturated. As in FIG. 1*a*, saturated beds herein represent a stored capacity to cool which is subsequently utilized as described in FIGS. 1*b* and 3*b*. Controlling logic relating to heating loads forecasted versus cooling loads forecasted determines whether it makes sense to store energy in the form of saturated (loaded) beds at the cylinders' upper pressure limit (stored capacity to cool) or to store energy in the form of regenerated beds at the cylinders' lower pressure limit (stored capacity to heat). Controlling logic is described in depth in the prior patent applications referenced herein and is included herein by reference.

FIG. 3*b* illustrates the modified GH-800 of FIG. 3*a*. In FIG. 3*a*, mechanical energy was input by the air compressor, a heating function was performed, and a stored energy capacity to cool was created in the form of a plurality of saturated beds at the cylinders' pressure limits. In FIG. 3*b* the stored capacity to cool is utilized passively, with no mechanical energy input. The exhaust valve of the desorbing bed 55 is controllably throttled in response to the signals from a thermostat such that the desired temperature is maintained in the cooling application 39 (the building is kept cool). A cooling 69 absorbs heat from an application B heat exchange 71 which in turn absorbs heat from the cooling application 39. The air and H2O vapor exhausted from the desorption process may be cooler than ambient temperature in which case it may be utilized in the cooling application process.

FIG. 3*c* illustrates a heat exchange system for temperature exchange between the GH-800 and the heating and cooling applications for use in FIGS. 3*a* through 6*b*. The cylinder containing the desorbing bed 55 is wrapped with a heat exchange coil 73 such that it is in communication with the thermal properties thereof and a fluid therein can selective communicate heat to the bed during the desorption process and communicate heat from the bed during the adsorption process. An exchange valve I 77 is controllable switched between 1 of 3 states including open to the heating application, open to the cooling application, and closed. An exchange valve II 79 is controllable switched between 1 of 3 states including open to the heating application, open to the cooling application, and closed. When the cylinder is in the desorption process, the exchange valve I 77 and the exchange valve II 79 are both switched to be open to the cooling application 39 such that fluid is driven from a heat exchange pump I 75 through the valves and the heat exchange coil 73 to deposit heat from the cooling application 39 into the desorbing bed 55 via a application B heat exchange 71 which is in thermal communication with the cooling application 39 and thereby cools it. The valves and heat exchange pump I 75 operate in response to signals from the thermostat that controls the temperature of the cooling application 39 to maintain its temperature. When the cylinder is in the adsorption process, the exchange valve I 77 and the exchange valve II 79 are both switched to be open to the heating application 31 such that fluid is driven from a heat exchange pump II 81 through the valves and the heat exchange coil 73 to deposit heat from the adsorption bed into the heating application 31 via an application A heat exchange 65 which is in thermal communication with the heating application 31 and thereby heats it. The valves and heat exchange pump II 81 operate in response to signals from the thermostat that controls the temperature of the heating application 31 to maintain its temperature. Thus a single heat exchange system interfaces the GH-800 with both heating and cooling applications.

FIG. 4*a* illustrates the GH-800 modified of FIGS. 3*a* through 3*c* performing concurrent adsorption, and desorption processes. While FIG. 3*a* describes the system focused on performing a heating adsorption to achieve a heating function and to achieve a stored capacity to cool function, and FIG. 3*b* describes the system focused upon performing a passive desorption to achieve a cooling function, FIG. 4*a* describes the system concurrently performing both adsorption and desorption. The unmodified GH-800 of FIG. 2 is designed to perform concurrent adsorption and desorption, it is the specific reason why the GH-800 ships with two adsorption cylinders instead of one. Our modification of the GH-800 enables modified timing of valve opening, throttling and closing to allow more operational flexibility. Adsorption is performed by opening or throttling a cylinder's intake valve and closing or throttling its exhaust valve, desorption is performed by closing or throttling the cylinder's intake valve while opening or throttling its exhaust valve. These processes can be done concurrently or non-concurrently.

One scenario when adsorption and desorption need to be performed concurrently is when a heating application and a cooling application need to be performed concurrently. Another scenario when adsorption and desorption need to be performed concurrently is when a heating application must be performed but all of the beds are already saturated (loaded). A third scenario when adsorption and desorption need to be performed concurrently is when a cooling application must be performed but all of the beds are already regenerated.

FIG. 4*b* illustrates the GH-800 modified of FIG. 4*a* performing an alternate process flow including concurrent adsorption, and desorption processes. A recirculating air pump 22*a* is configured to accept its air intake from the desorbing exhaust manifold such that H2O vapor exhaust from the desorbing bed is drawn from the desorbing bed and directed to the adsorbing bed 49. Heat from the adsorption can be used to heat the heating application 31 and cooling from the desorption process can be used to cool the cooling application 39. The desired flow is achieved by opening the exhaust valve on the desorbing bed cylinder and opening the intake valve on the adsorbing cylinder while other valves on those cylinders remain closed or throttled. The advantage of this approach is that the desorption exhaust stream will have a higher moisture content enabling more efficient adsorption, also a vacuum can be pulled on the desorption bed making desorption more efficient. The disadvantage being that gas circulated in this closed loop may diminish efficiency by bringing cool temperature fluid into the adsorption process. To mitigate this effect, the fluid can exchange heat with the cooling application or an intervening fluid holding tank can be added to allow the desorption bed exhaust to be warmed to ambient temperature before introducing it to the adsorbing bed.

FIGS. 5*a* through 6*b* illustrates the GH-800 modified as above operating on a vacuum (negative pressure) swing adsorption cycle. The operating principles are the same as is described in FIGS. 3*a* through 4*b*. A vacuum air pump 22*b* replaces the air pump previously discussed. During desorption, the vacuum pump receives exhaust from desorption beds and outputs it to the environment. During passive adsorption such as in FIG. 5*b*, the adsorbing bed 49 is throttled from less than 1 ATM to 1 ATM to perform the passive heating application. During closed loop adsorption as in FIG. 6*b*, a recirculating vacuum pump 22*c* pressures the adsorbing bed to be above 1 ATM.

Prior Art Processes, Apparatuses and Cycles

FIG. 7*a* illustrates the apparatus and operating cycle of a prior art absorption system. The absorption system is currently used for cooling function and is selected primarily because it accepts heat as an input to produce cooling as an output. Other than valves and a circulation pump, it has no moving parts but its efficiency is generally less than COP of 1. A desorber 103 is a tank that contains an ammonia and water mixture. In a heat driven desorbtion 101 process heat is used to desorb the ammonia out of the water. Waste heat, solar heat, or heat from burning a fuel can all be applied to the desorber 103 to desorb the ammonia from the ammonia water mixture to be ammonia gas. Pressure created by the heat swing in the desorber 103 drives ammonia gas through a check valve A 105 that controllably allows the gas ammonia to flow from the desorber 103 to a condenser 111 with a condensation heat 109 being released into the environment as the ammonia gas phase changes to a liquid. The ammonia liquid still has adequate pressure to flow from the condenser 111 through a check valve B 113 that controls its flow to an evaporator 115. The check valve B throttles fluid flow to maintain pressure in the condenser 111 while achieving the desired rate of evaporation in the evaporator 115 and therefore the desired rate of a heat extracted from cooling application A 117 and thereby a cooling application A 119 is achieved. A check valve C 121 controls the flow of ammonia liquid back to an absorber 123 where ammonia is absorbed back into the water and a heat from absorption 125 is release into the environment. A circulation pump 127 keeps the water and ammonia moving between the desorber 103 and the absorber 123.

The art of FIG. 7*a* is contrasted with the art of prior Figures herein and Figures subsequent to FIG. 7*b* herein in the cycle, the apparatus, and the processes involved. FIG. 7*a* relies on a cycle of desorbtion, condensation, evaporation, and absorption. A pressure swing is created in the desorber by a heat swing and the cooling objective is achieved by evaporation. The present art herein relies on using a pressure swing to create a heat swing and achieving the cooling objective by desorption.

FIG. 7*b* illustrates the apparatus and operating cycle of a prior art adsorption system. The absorption system of FIG. 7*b* is currently used to perform cooling functions and is selected primarily because it accepts heat as an input to produce cooling as an output. Other than valves, it has no moving parts but its efficiency is generally less than COP of 1. A desorption in sorption bed 1 133 is achieved by a heat driving desorption 131 process whereby heat is used to cause ammonia desorption in a sorption bed within a tank. Waste heat, solar heat, or heat from burning a fuel can all be applied to the desorption in sorption bed 1 133 process to cause ammonia gas desorption from the sorption bed 1. Pressure created by the heat swing in the sorption bed 1 drives ammonia gas through a check valve D 135 that controllably allows the gas ammonia to flow from the sorption bed 1 to an adsorbate condenser 137 with an adsorbate condensation heat 139 being released into the environment as the ammonia gas phase changes to a liquid. The ammonia liquid still has adequate pressure to flow from the an adsorbate condenser 137 through a check valve E 141 that controls its flow to an adsorbate evaporator 143. The check valve E throttles fluid flow to maintain pressure in the an adsorbate condenser 137 while achieving the desired rate of evaporation in the adsorbate evaporator 143 and therefore the desired rate of a heat for evaporating adsorbate 145 and thereby a cooling application B 147 is achieved. A check valve F 149 controls the flow of ammonia liquid back to an adsorption in sorption bed 2 process where ammonia adsorption occurs and a heat from sorption bed 2 155 is release into the environment.

The art of FIG. 7*b* is contrasted with the art of subsequent Figures herein and Figures herein prior to FIG. 7*a* in the cycle, the apparatus, and the processes involved. FIG. 7*b* relies on a cycle of desorption, condensation, evaporation, and adsorption. A pressure swing is created in the sorption bed 1 by a heat swing and the cooling objective is achieved by evaporation. The present art herein relies on using a pressure swing to create a heat swing and achieving the cooling objective by desorption.

Sourcing the adsorbate from the environment as discussed above can also produce a valuable by product. For example, once water is separated from air, it can be placed in a storage tank and utilized as potable water. Extracting water from the environment as a working fluid and then utilizing it as a potable water supply is discussed in U.S. patent application Ser. No. 12/586,784 of which this is a Continuation in Part and which is incorporated herein by reference.

Second Embodiment

Closed System

FIG. 8*a* illustrates the apparatus, cycle, and processes of a two bed pressure swing adsorption system modified for the purposes of achieving a temperature swing to perform heating and cooling applications. The apparatus described in FIGS. 1*a* through 6*b* as an open system using air derived H2O as the adsorbate and is modified as discussed in FIGS. 8*a* through 13 to operate as a closed system with CO2 as the adsorbate (alternately as in FIG. 12*a* propane as the adsorbate). The modified GH-800 described above is further modified and operated as follows. CO2 is used as the adsorbate and zeolite 13X is used as the adsorbent both are commercially available from multiple sources. An adsorbate compressor 165 is the same air compressor from the GH-800 and is used to perform mechanical work 167 in evacuating, compressing, pumping, and transporting CO2 adsorbate between the apparatuses and steps described herein. The adsorbate compressor 165 creates a negative pressure swing on its input side and a positive pressure swing on its output side. A compressor bypass valve 168 is a solenoid switchable valve provided to enable adsorbate working fluid to passively flow from a high pressure to a low pressure without going through the pump as later described. Solenoid valves suitable for directing the flow of CO2 at the pressures utilized herein being widely available for purchasing. Also provided are a four way valve A switched to first setting 185*a* and a four way valve B switched to first setting 183*a*. Each of these valves include four input/output ports each of which being individually solenoid switchable to direct CO2 adsorbate flow according to thermostat input and other electronic inputs as described in FIG. 13 and elsewhere herein. Combinations of suitable solenoid switchable valves can be acquired from multiple commercial sources. All valves herein can be switched between settings including open, and closed, and controllably throttled to allow fluid flow at a controlled rate. An adsorbate storage 161 means is also provided and switchably accessible to the adsorbate compressor input, the adsorbate compressor output, and sorption bed A and sorption bed B. As illustrated in FIG. 11*a*, the adsorbate storage 161 may comprise one of a variety each of which offer different advantages in integrating the present invention with other fluid supply or energy transformation systems as later discussed.

In FIG. 8*a*, the adsorbate compressor 165 creates a negative pressure swing on its input side thereby pulling CO2 working fluid through the four way valve A switched to first setting 185*a* thereby causing a sorption bed A performing desorption 171 to undergo a pressure decrease and CO2 desorption to occur. A desorption heat from application 175 is extracted via the heat exchanger such as described under FIG. 3*c* from an application to be cooled 177. Thus a negative pressure swing, causes desorption, and a corresponding negative temperature swing wherein heat is extracted from an application to be cooled.

Concurrently, on the high pressure side of the adsorbate compressor 165, CO2 adsorbate is transferred through the four way valve B switched to first setting 183*a* to a sorption bed B performing adsorption 181 where the increasing pressure causes the CO2 adsorbate working fluid to undergo adsorption. An adsorption heat output 173 is directed to an application to be heated 174 via the heat exchanger such as described under FIG. 3*c*. Thus a positive pressure swing, causes adsorption, and a corresponding positive temperature swing wherein heat is delivered to an application to be heated. Moreover, using the art of FIG. 8*a*, a cooling application and a heating application are both achieved concurrently. An example of concurrent heating and cooling needs include cooling a building and heating hot water. A second example is in meat processing where cold storage is needed to keep the meat fresh and hot water is need to clean working surfaces. As described in FIGS. 8*b* through 13, the apparatus of FIG. 8*a* is switchably configurable to support a variety of alternate process steps that comprise cycles optimized for efficient use of work input, heating applications, cooling applications, and of using loaded beds and regenerated beds as an energy energy storage means, and for using pressure differentials as an energy storage means, as well as a control system for leveraging these advantages. Sensors and other inputs described in FIG. 13 including thermostats are used to determine when to switch the compressor on or off and when to switch valves to redirect flow to achieve desired CO2 adsorbate working fluid flow and resultant desired thermal energy transfers to and from applications.

Operation of this system where adsorption bed temperature is maintained at 100° F. and the desorption bed temperature is maintained at 40° F. and in a two bed system where the beds have not yet acquired ambient temperature (the adsorbing bed is still cold from a prior desorption process and the desorption bed is still hot from a prior adsorption process, this is the case when transitioning from FIG. 8*a* to FIG. 8*b*) the apparatus and cycle of FIG. 8*a* cooling COP is calculated as:

((Sorptive energy BTU/cu. ft)−(capacitive energy BTU/cu. ft))/Pump energy BTU(efficiency.85) ((1220.6)−(788.7))/349.43=1.236 COP when the compressor is running Half of the cycle can run with no compressor running (when there is a pressure differential between the beds, working fluid flows with no mechanical work input needed. Thus total COP=1.236×2=COP of 2.472

Efficiency can be improved with a four bed system where the beds commencing adsorption and desorption are first allowed to reach ambient temperature before those processes commence as follows:

2.472×1.3 greater efficiency in adsorption×1.05 greater efficiency in desorption=COP of 3.34

A resultant COP of 3.34 is within a range that can compete commercially with high efficiency vapor compression systems. Moreover if the heat output and heat input both are utilized for beneficial functions, our derived benefits COP is 3.34×2=COP of 6.68.

FIG. 8*b* illustrates the apparatus of FIG. 8*a* configured to operate in a reverse flow. Both a four way valve A switched to second setting 185*b* and a four way valve B switched to second setting 183*b* have been switched to reverse flow through components of the system. CO2 adsorbate working fluid flows from a sorption bed B performing desorption 181*a* through the four way valve B switched to second setting 183*b* through the adsorbate compressor 165 through the four way valve A switched to second setting 185*b* and into sorption bed A performing adsorption 171*a*. The desorption in the sorption bed B performing desorption 181*a* is used for cooling and concurrently the adsorption in the sorption bed A performing adsorption 171*a* is used for heating. Thus the system in FIGS. 8*a* and 8*b* are a continuously operational cycle whereby in response to a thermostat and other control signals a cooling application can be achieved and/or a heating application can be achieved.

FIG. 9*a* illustrates the apparatus of FIGS. 8*a* and 8*b* operationally integrated with the adsorbate storage 161. A four way valve A switched to third setting 185*c* is switched to direct CO2 adsorbate working fluid from the adsorbate storage 161 through the adsorbate compressor 165 through the four way valve B switched to second setting 183*a* and into the sorption bed B performing adsorption 181 with a heating application being performed as previously discussed. When the adsorbate storage 161 is a tank to contain adsorbate, the ideal tank characteristics include a capacity to store all the CO2 working fluid required to fully load both beds within the systems operating parameters. As later discussed, the advantage of storing that amount of working fluid is that both sorption beds when fully loaded are a stored capacity to cool without the need of mechanical work by the adsorbate compressor 165. Similarly, the advantage of storing that amount of working fluid is that both sorption beds when fully regenerated whereby storing all the CO2 working fluid (within operational parameters) is a stored capacity to heat without the need of mechanical work by the adsorbate compressor 165. In FIG. 9*a*, a sorption bed A loaded with adsorbate 171*b* is at a pressure higher than the adsorbate storage and higher than the sorption bed B performing adsorption 181 such that as later discussed, working fluid can flow to either from the sorption bed A loaded with adsorbate 171*b* without work from the adsorbate compressor 165.

FIG. 9*b* illustrates the apparatus of FIG. 9*a* operationally integrated with the adsorbate storage 161. A four way valve B switched to third setting 183*c* is switched to direct CO2 adsorbate working fluid flow from the sorption bed B performing desorption 181*a* through the four way valve B switched to third setting 183*c* through the adsorbate compressor 165 through the four way valve A switched to second setting 185*b* and into the adsorbate storage 161. The cooling application is achieved as previously discussed. A sorption bed A regenerated 171*c* is a bed that has been regenerated, with all of its CO2 working fluid desorbed (within operational parameters). Its pressure is lower than the pressure within the adsorbate storage and within the sorption bed B performing desorption 181*a* such that, as later discussed, switching of valves lets working fluid passively flow to it without any additional work by the adsorbate compressor 165.

FIG. 10*a* is the system of FIG. 9*b* switched to perform heating and cooling applications without concurrent mechanical work input. The preceding describes operational cycles including concurrent operation of the adsorbate compressor 165, in FIG. 10*a* an adsorbate compressor switched off 165*a* does not perform any concurrent work on the CO2 adsorbate working fluid flow. Instead the adsorbate compressor is switched to be off and a compressor bypass valve switched to open 168*a* and throttled to control flow therethrough.

Pressure in the sorption bed B performing desorption 181*a* exceeds pressure in the sorption bed A performing adsorption 171*a* such that CO2 adsorbate working fluid passively flows without need for mechanical work thereon. This Figure and other Figures herein indicate how energy can be stored in the form of adsorbate positive pressure (a stored capacity to cool by desorption) and in the form of adsorbate negative pressure (a stored capacity to heat by adsorption). As in FIGS. 12 *a* and 12*b* such pressure differentials are first created when renewable energy is abundant or when electricity is cheap, then stored in the form of a pressure differential, and finally utilized to perform a heating and or cooling function when renewable energy is scare an electricity is more expensive. In FIG. 10*a*, the pressure differential causes CO2 adsorbate working fluid to flow from the sorption bed B performing desorption 181*a* through the four way valve A switched to second setting 185*b* through a compressor bypass valve switched to open 168*a* through the four way valve B switched to second setting 183*b* and into the sorption bed A performing adsorption 171*a*. The cooling function and the heating function are performed from the stored pressure differential between two sorption beds with no concurrent mechanical work needed on the CO2 adsorbate working fluid. Once the pressures between the beds and or the adsorbate storage are equalized, then the adsorbate compressor is engaged to do work as in FIGS. 8*a* through 9*b*. Thus a full cycle may comprise first working fluid flowing due to a stored pressure differential and adsorption and/or desorption being performed with not work input by the adsorbate compressor and flow being controlled only by valves, then working fluid flowing due to work input by the adsorbate compressor and adsorption and/or desorption being performed, then repeating these steps.

FIG. 10*b* is the system of FIG. 10*a* with a cooling function performed from the stored pressure differential between one sorption bed and the adsorbate storage with no concurrent mechanical work needed on the CO2 adsorbate working fluid. The pressure within sorption bed B performing desorption 181*a* is greater than the pressure within adsorbate storage 161 such that CO2 adsorbate working fluid passively flows from the former to the latter with no mechanical work thereon needed. A four way valve B switched to forth setting 183*d* and a four way valve A switched to forth setting 185*d* are switched to accommodate the flow.

FIG. 10*c* is the system of FIG. 10*b* with a heating function performed from the stored pressure differential between one sorption bed and the adsorbate storage with no concurrent mechanical work needed on the CO2 adsorbate working fluid. A four way valve B switched to fifth setting 183*e* and a four way valve A switched to fifth setting 185*e* are controllably set to throttle flow from the higher pressure adsorbate storage 161 to the lower pressure in the sorption bed A performing adsorption 171*a*. A sorption bed B loaded with adsorbate 181*b* illustrates a stored capacity to cool. Each bed herein has the ability to be in one of at least four states including, adsorption, desorption, loaded, and regenerated. Of course intermediary states and beds at rest are also possible.

FIG. 11*a* illustrates examples of some adsorbate storage systems. As discussed above, adsorbate storage 161 can take the form of an adsorbate tank 161*b*. The tank should be large enough to contain enough CO2 adsorbate that can both fully regenerate both sorption beds and can fully load both sorption beds. The advantage of adding the adsorbate tank is that both beds can be utilized to either store a capacity to heat (be fully regenerated) or store a capacity to cool (be fully loaded). If two beds are used, both beds can not be concurrently either both loaded or both regenerated without providing an adsorbate storage mechanism.

A natural gas pipeline 161*a* supplies natural gas to many buildings within the United states. The art herein can be integrated with the natural pipeline such that the natural gas pipeline provides the adsorbate storage mechanism from which adsorbate is pulled when needed and to which adsorbate is returned when not needed. In this special embodiment, natural gas is the adsorbate instead of CO2. Natural gas primarily comprises methane which has the disadvantage of a relatively low heat of adsorption but the advantage of integrating well with other systems similar to role that propane performs in FIG. 12*a* and can similarly leverage the control inputs and outputs of FIG. 13 as well as the business processes and apparatuses described in U.S. patent application Ser. No.

12/586,784 of which this is a Continuation in Part and which is incorporated herein by reference.

Similarly, the adsorbate storage 161 can take the form of a hydrogen supply system 161*c*. Many observers believe that hydrogen is the most viable clean energy solution. It is incorporated herein because replacing the CO2 adsorbate working fluid with a hydrogen adsorbate working fluid with the cycles and processes described herein offer an additional value proposition to leverage the cost of a hydrogen storage and supply system. A hydrogen storage and supply system provides hydrogen to burn, to generate electricity, and using the present invention to store energy in the form of pressure differentials as part of an adsorption and or desorption cycle.

FIG. 11*b* illustrates the present invention integrated with the prior adsorption system of FIG. 7*b*. It offers the advantage switchably being able to alternately operate in a mode that utilizes temperature swing adsorption driven evaporative cooling of 7*b* or operate according to the adsorptive cooling of the present invention. An adsorption heat exhausted 173*a* is approximately equal to the waste heat input.

FIG. 12*a* illustrates integration of the present art pressure swing adsorption system with an electric, wind, and propane energy transformation system that accepts a variety of energy inputs and produces a variety of energy outputs, and is similar to that described in U.S. patent application Ser. No. 12/586,784 of which this is a Continuation in Part and which is incorporated herein by reference. An integrate multi-component energy transformation is also described in U.S. patent application Ser. No. 12/653,521 of which this is a Continuation in Part and which is incorporated herein by reference.

An electric motor solenoid pulley 401 and the other pulleys herein are of a kind found under the hood of most automobiles. These solenoid pulleys interface with a serpentine belt 403 and they are solenoid switchable to be engaged or non-engaged. The electric motor solenoid pulley 401 is engaged when an electric motor 167*a* is powered to input mechanical energy into the serpentine belt for the purpose of driving the adsorbate compressor 165. The electric motor solenoid pulley 401 is also engaged when the electric motor 167*a* is utilized to generate electricity such as in FIG. 12*b* when a working fluid pressure differential exists, or when propane or wind energy are utilized to put mechanical energy into the serpentine belt to generate electricity as later discussed. When the electric motor solenoid pulley 401 is switched to non-engaged, the pulley can spin freely with the serpentine belt without turning the elements within the electric motor. A compressor solenoid pulley 405 is switched to engaged to drive the adsorbate compressor 165 when a propane adsorbate working fluid compression is needed to provide either an adsorption or a desorption process. A propane engine 407 can be fired if there is no wind energy or electricity or if electricity costs are calculated to be more expensive than propane. When the propane engine runs a propane engine solenoid pulley 409 is engaged to transmit its mechanical energy to either the electric motor 167*a* to generate electricity or to the adsorbate compressor 165 to perform adsorption, or desorption or both, or to create a working fluid pressure differential to store energy.

A wind turbine solenoid pulley 413 is provided to be engaged when the wind is blowing and a wind turbine 415 can capture energy which is transmitted by the wind turbine solenoid pulley 413 in the form of mechanical energy to drive either the electric motor 167*a* to generate electricity or to drive the adsorbate compressor 165 to perform adsorption, or desorption or both, or to create a working fluid pressure differential to store energy. When the wind is not blowing, the wind turbine solenoid pulley 413 is non-engaged. The wind turbine 415 utilized herein is a micro-turbine available from multiple suppliers modified to remove the turbine's generator and to deliver mechanical power instead of electrical power. It can generate enough mechanical power to drive the system of FIG. 12*a* when the wind is blowing 7 miles per hour or greater. It is estimated for example that a building scale wind micro-turbine installed on a typical building at the US Army's Fort Irwin Calif. base can provide enough mechanical energy to provide for greater than 50% of the building's heating and cooling needs with some amount of electricity generation as well.

A propane burner 411 is provided to heat applications when that is cheaper or more efficient than using pressure swing adsorption. A propane tank 161*d* is of the kind that is commonly utilized as a propane fuel storage tank. Thus the art described herein can be powered through alternate mechanisms as part of a fully integrated energy transformation system with inputs including wind, electricity, and fuel and outputs including, heating, cooling, energy storage, and electricity production. The electronic, firmware, and software to control the systems including the logic to make decisions is illustrated in FIG. 13.

FIG. 12*b* illustrates use of the pressures differential described previously as a mechanism to generate electricity. A fluid turbine 421 is provided that turns when a pressure differential exists between its input port and its output port. It can be affixed to a solenoid pulley and engaged and disengaged to add mechanical energy to the serpentine belt such as the pulleys described in FIG. 12*a*. A back pressure work 423 is performed due to the pressure differential between two sorption beds or between a sorption bed and the adsorbate storage. A first turbine valve 483 and a second turbine valve 485 are provided to direct flow between the beds and the turbine's input and output ports. The fluid turbine and the adsorbate compressor can both be merged into a single element using a compressor that operates in a suitable pressure range and selectively acts as a compressor when mechanical energy is input and a pressure differential is output and alternately can be switched to act as a turbine to create mechanical energy from a pressure differential.

FIG. 13 illustrates the electronic, firmware, and software required to operate the apparatus, processes, and cycles described herein. FIG. 13 is similar to that described in U.S. patent application Ser. No. 12/586,784 of which this is a Continuation in Part and which is incorporated herein by reference.

A microcontroller 301 includes the required elements and interfaces to collect data, execute calculations, and control operation of elements and steps in all Figures throughout this application. The microcontroller is integrated during manufacture with stamped circuits 306 including a thermostat user interface for inputting user settings, and a temperature sensor. The microcontroller includes embedded RAM memory that is programmed with logic that forms the basic operations of the microcontroller. The microcontroller includes a programmable memory to store data tables and store logic and formulas. Prior to operation, the RAM and programmable memory comprise memory functions 303 that includes programming of memory with stored logic, controlling program instructions, and comparator algorithms. During operation the memory functions 303 are used by the CPU to store calculated values, store learned logic, store calculated schedules, store forecasts that are acquired externally, and to store controlling instructions and data.

The microcontroller includes a CPU for performing processing steps 305 that control operations, populates the data tables, calls to data tables, calls to external data, and processes the logic including performing calculations that optimize operational efficiency of the system. In addition to coordinating logic steps, the CPU performs calculations to optimize system performance and minimize cost and energy consumption including, calculating forecasted BTUs required over a 1 week future time period, calculating forecasted BTUs stored at any given point in time over a 1 week time period, calculating lowest cost fluid compression windows, calculating most efficient expansion windows, calculating run time schedules 1 week in advance, calculating that safe operating conditions are always present, comparing flow volumes measured to flow volumes calculated, calculating the cheapest energy source, outputting control instructions based upon calculations, and controlling as in FIG. 12*a* whether to use wind powered compression, electric powered compression, or propane powered compression.

The microcontroller includes input/output ports to interface with external devices such as failure outputs 319 that are triggered when an interrupt sequence occurs such as a system failure which causes a shut down of all valves the sounding of an alarm and an automated call to a service technician wirelessly or over the Internet. Such a system failure may be sensed through sensor inputs 307 which are connected to the microcontroller such as a leak detector, pressure sensors, flow sensors, carbon dioxide sensor, carbon monoxide sensor, and a power outage sensor. High priority inputs can cause interrupts to other processes due to their higher priority. A real-time inputs 309 connectivity includes input such as real time temperature within the building and within real-time heat sinks 310 such as air source, ground source, and water source, real-time outside humidity, real-time cloudiness each of which are included in calculating real BTU loads and also cheapest operating times. The microcontroller includes a serial port to enable Internet inputs and outputs 311 such as gathering forecasted electricity cost, forecasted electric grid utilization, forecasted propane fuel cost, forecasted temperatures, forecasted cloudiness, forecasted humidity, forecasted precipitation, forecasted windiness, registration of future commodity purchases, reporting real time conditions, reporting operation schedule, reporting historic system usage, and calling for service. The serial port may be able to connect directly to an internet 313 or indirectly to the internet through a computer 315. Outputs from the microcontroller include signals to a set of controlled devices and processes 317 including turning on and off the compressor, turning fans on and off, opening, throttling, and closing the valves, turning the generator on and off, turning the burner on and oft turning the electric motor on and off, illuminating LEDs to indicate status, and displaying status on a display screen.

The microcontroller includes analog to digital and digital to analog converters to support a range of input and output interfaces. The microcontroller also includes a timer to ensure that processes are attended to on a timely basis and steps are executed logically.

Propane burner logic (to be used when thermostat set to "Heat" and not to be used when thermostat set to "Cool"). At present and at each future point in time for a period 7 days in the future, calculate whether to burn propane. Get price of electricity forecast from Internet, populate predicted electricity cost table. Get price of propane forecast from internet, populate propane cost schedule table.

Electricity Price for propane heat pump per million BTU (MBTU) heat equals (price of electricity/mbtu)/(COP)=EPM Propane Price for propane burner per million BTU heat equals (price of propane/mbtu/(burner efficiency)=PPM Is EPM>PPM? if yes schedule turn off heat pump and turn on propane burner.

Propane generator logic. At present and at each future point in time calculate whether to burn propane to generate electricity.

Is power out? If yes turn on propane generator.

Get price of electricity forecast from internet, populate predicted electricity cost table. Get price of propane forecast from internet, populate propane cost schedule table.

Cost to buy electricity=CBE

Cost to generate electricity=CGE

CBE populated from internet electric GRID data.

CGE calculated as Propane Price for propane burning generator (price of propane/mbtu/(generator burn efficiency) =CGE Is CBE>CGE? if yes schedule turn on propane burning generator.

If hourly costs forecasted to purchase electricity or propane consistently vary from hourly cost actually incurred, learn to adjust future hourly cost forecasts by a consistent deviation variable.

Calculate BTUs needed for cooling (7 Day cooling load for building)

Get weather forecast for 7 days from internet, populate tables.

Get hourly forecasted temperature, populate forecasted temperature table.

Get hourly forecasted humidity, populate forecasted relative humidity table

Get hourly forecasted cloudiness, populate forecasted precipitation table.

Get hourly forecasted windiness, populate forecasted windiness table.

BTUs required hourly assigned variables HOUR1, HOUR2, . . . HOUR168

HOUR1=((0.75×1$^{st}$ hour temperature)+(0.1×1$^{st}$ hour humidity)+(0.2×(1/1$^{st}$ hour daytime cloudiness factor))+(0.1×1st hour windiness factor))×Average BTUs/hour=Calculated BTUs Cooling required for HOUR1

Perform similar estimate for hours 2 through 168. Populate calculated BTU required table.

Add hour calculated BTUs to calculate daily BTUs needed forecast, assign to variables DAY1, DAY2 . . . DAY7

For each of temperature, humidity, cloudiness, and windiness, the above formula includes first a weighting then a numerical variable. As the system operates it can compare actual BTUs used compared to calculated BTUs to tweak either the weights, or the weather forecasts, or the average BTUs/hr to improve accuracy in calculations.

When executing cooling function, CPU compares estimated weather forecast to actual weather forecast and where a consistent deviation is present adjusts future forecasts by a variable thereby learning a more accurate weather forecast simulation process. For example if actual temperature is 5 degrees cooler on average, the system will learn to subtract 5 degrees from future weather forecast data pulled from the Internet. Forecasted weather compared to actual weather can consistently and predictably vary in certain scenarios for example when the system is located at a different elevation than the weather forecasting/reporting station.

When executing cooling function, CPU compares calculated BTUs for HOUR1 to actual BTUs needed in the first hour and where a consistent deviation is present adjusts the formula thereby learning a more accurate calculation formula for example respective weights assigned to temperature, humidity, cloudiness, and windiness.

Calculate cooling BTUs available at each future point in time, and populate calculated BTU stored table.

Cooling BTUs in liquid storage cylinder=LSDAY1, LSDAY2, . . . LSDAY7

LSDAY2=LSDAY1−DAY1+PBTU1, LSDAY3=LSDAY2−DAY2+PBTU2, etc.

Where PBTU1, PBTU2 . . . PBTU7 are BTUs pumped and stored each day, and populated in a table as below.

Compressor running parameters

Real time Stored BTU=SBTU, SBTU is not allowed to go below 200,000 BTU

If SBTU<200,000 then run compressor

If SBTU>700,000 then stop compressor

Calculate cheapest pump running times according to predicted electricity cost table. Get price of electricity forecast from internet, populate table in forecasted hourly costs.

Cost to buy electricity hourly for 1 week=CBE1, CBE2, CBE3 . . . CBE168

Compare CBE1 to CBE2 to . . . CBE 168, rank lowest to highest

Saturday and Sunday have electricity cost windows as low as $0.10/kwh. The pump running schedule can be based upon this fact alone, cheapest cost of electricity approximates cheapest running time. A more complex calculation especially suited for air sourced pump and condenser heat dissipation includes the most efficient pump running times based upon weather conditions forecasted as populated above. Calculations include weighted pump and condenser efficiencies when dissipating heat including forecasted temperature table, and forecasted relative humidity table. The pump and condenser efficiency performance formula is inversely proportional to heat sink source temperature. When pump running calculations include the low night time temperature of 69 degrees on Thursday together with the low humidity on Thursday, the system calculates a compressor run schedule 213 whereby, due to weather efficiencies, it is cheaper to run the compressor on Thursday at the $0.12/kwh electricity cost than it is to run the compressor on Saturday or Sunday at the $0.10/kwh. The compressor run schedule 213 is populated accordingly including scheduled hourly and daily pumped and stored BTUs with variables assigned such as Day 1=PBTU1 as used above for keeping track of stored BTUs to ensure there will always be enough planned BTUs available to accommodate the calculated building cooling load according to the weather forecast, calculated BTU usage in the future and calculated BTUs to be produced and stored according to the calculated compressor pump run time schedule. Thus predicted stored BTUs on Thursday at 700,000 which is full capacity of the high pressure storage cylinder.

AVG btu stored per hour is a pump specification=BTU/HR and in this system the pump can produce 30,000 BTU/hr of cooling capacity.

Calculate number of compressor running hours needed for 1 week according to weather forecasts. 418,000 BTUs are calculated to be needed according to the calculated BTU required table which equates to 13.9 hours of pump run time required to fulfill the building cooling load for the week.

While this illustrates a prior art application of pressure swing adsorption cycle and apparatus utilized for a cooling application, the present invention describes and claims more complex cycles, integration of mechanical energy inputs, multiple adsorption beds, application of pressure swing adsorption to both heating and to cooling applications, achieving heating and cooling applications concurrently, loading one or more beds as a stored capacity to cool, regenerating one or more beds as a stored capacity to heat, using a pressure differentials to passively cool, using a pressure differential to passively heat, maximizing the effective energy storage capacity of sorption beds by inducing an adsorbate tank, a system for leveraging pressure differentials between sorption beds to maximum advantage, integrating pressure swing adsorption heating and cooling with other forms of energy transfer, and a electronic, firmware, software control system to take advantage of these preceding apparatuses, cycles, and advantages.

For all figures that include a heat in or a heat out it is understood that a heat exchange mechanism facilitates this heat transfer although the heat exchanger is not illustrated in every figure herein or referenced in every discussion thereof.

Operation of the Invention

Operation of the invention has been discussed under the above heading and is not repeated here to avoid redundancy.

CONCLUSION, RAMIFICATIONS, AND SCOPE

Thus the reader will see that the apparatus and processes of this invention provides an efficient, energy saving, greenhouse gas reducing, thermal pollution reducing, novel, unanticipated, highly functional and reliable means for heating and cooling buildings and storing energy in the form of the capacity to cool and the capacity to heat.

The preceding has described H2O, CO2, and propane as adsorbates, it is understood that any fluid or combination of fluids can comprise the adsorbate. The preceding has described activated silica gel or 13X zeolite as the adsorbent, it is understood that any other adsorbent may be substituted. The goal being to minimize acquisition and operational costs while maximizing efficiency and energy storage density.

In the first embodiment the after cooler has been removed however the after cooler may be included. The kJ/mol of H2O vapor adsorption under certain conditions is approximately equal to the kJ/mol of H2O vapor condensation. Depending upon operational conditions and requirements, it may be more efficient to include the after cooler and other components that leverage the heat released from condensation and the heat absorbed from vaporization as inputs to the heating and cooling applications respectively.

Intervening steps, valves, pumps, sensors, actuators and other components may be added to enhance efficiency.

The heat exchange system described herein to enable heat exchange between the GH-800 and applications is one example, many heat exchange techniques are known and may be substitute to increase efficiency and reduce cost.

The terms "compressor" and "pump" have the same meaning in that through mechanical work they transfer a working fluid from a first location to a second location and/or transform working fluid from a lower pressure to a higher pressure.

While the above description describes many specifications, these should not be construed as limitations on the scope of the invention, but rather as an exemplification of a preferred embodiment thereof. Many other variations are possible.

What is claimed:

1. A thermal energy transfer system comprising;

a pump, a working fluid, a first sorption bed, a valve, a first element selected from the group consisting of, a second sorption bed, a working fluid storage tank, and a closed working fluid supply containment system, a thermal transfer application selected from the group consisting of, an application requiring heat, and an application requiring cooling, wherein said working fluid undergoes a process selected from the group consisting of, said working fluid pressure within said first element is lower than said working fluid pressure within said first sorption bed, and said pump transfers said working fluid from said selected first element to said first sorption bed thereby increasing pressure within said first sorption bed, and adsorption of said working fluid within said first sorption bed occurs as pressure increases, and a heat of adsorption is produced and applied to said application requiring heat, said working fluid pressure within said first element is lower than said working pressure within said first sorption bed, said valve is opened so that said working fluid is released from said first sorption bed to said selected first element, and desorption of said working fluid within said first sorption bed occurs as pressure therein decreases, and a heat of desorption is absorbed from said application requiring cooling;

working fluid pressure within said first element is higher than working fluid pressure within said first sorption bed, said pump transfers said working fluid from said first sorption bed to said first element, thereby lowering said working fluid pressure within said first sorption bed, and desorption of said working fluid within said first sorption bed occurs as pressure decreases, and a heat of desorption is absorbed from said application requiring cooling, and working fluid pressure within said first element is higher than working fluid pressure within said first sorption bed, said valve is opened so that said working fluid flows from said first selected element to said first sorption bed, and adsorption of said working fluid within said first sorption bed occurs as pressure within said first sorption bed increases, and a heat of adsorption is produced and applied to said application requiring heat.

2. The thermal energy transfer system of claim 1 wherein said working fluid storage tank is selected and includes an attribute selected from the group consisting of;

a fuel supply system that selectively supplies fuel to a burning process wherein said working fluid alternately serves as said fuel to said burning process, a water supply system that selectively supplies water for a use other than adsorption or desorption, and a hydrogen supply system that selectively supplies hydrogen to a process that generates electricity.

3. The thermal energy transfer system of claim 1 wherein said second sorption bed is selected and a working cycle comprises first transferring said working fluid from said first sorption bed to said second sorption bed, then transferring said working fluid from said second sorption bed to said first sorption bed.

4. The thermal energy transfer system of claim 1 wherein said second sorption bed is selected and a working cycle comprises said working fluid transfer from said first sorption bed at a higher relative pressure through said valve to said second sorption bed at a lower relative pressure, then said working fluid transfer from said first sorption bed at a lower relative pressure through said pump to said second sorption bed a higher relative pressure.

5. The thermal energy transfer system of claim 1 wherein said second sorption bed is selected and a working fluid storage tank is provided and a working cycle comprises bed regeneration by said working fluid transfer from said first sorption bed to said working fluid storage tank and said working fluid transfer from said second sorption bed to said working fluid storage tank, and the result being whereby said first sorption bed and said second sorption bed are concurrently in a regenerated state.

6. The thermal energy transfer system of claim 5 wherein heat of desorption for regenerating said first bed and heat of desorption for regenerating said second bed are absorbed from said application requiring cooling.

7. The thermal energy transfer system of claim 5 wherein in a subsequent step, a higher pressure within said storage tank propels working fluid to flow from said working fluid storage tank to said first sorption bed where adsorption occurs and the heat of adsorption is applied to said application requiring heat and higher pressure within said storage tank propels working fluid to flow from said working fluid storage tank to said second sorption bed where adsorption occurs and the heat of adsorption is applied to said application requiring heat.

8. The thermal energy transfer system of claim 1 wherein said second sorption bed is selected and a working fluid storage tank is provided and a working cycle comprises bed loading by said working fluid transfer from said working fluid storage tank to said first sorption bed and said working fluid transfer from said working fluid storage tank to said second sorption bed, and the result being whereby said first sorption bed and said second sorption bed are concurrently in a loaded state.

9. The thermal energy transfer system of claim 8 wherein heat of adsorption within said first bed and said second bed is applied to said application requiring heat.

10. The thermal energy transfer system of claim 8 wherein in a subsequent step, higher pressure within said first sorption bed propels said working fluid to flow from said first sorption bed to said working fluid storage tank such that desorption occurs in said first sorption bed and heat of desorption is absorbed from said application requiring cooling, and higher pressure within said second sorption bed propels said working fluid to flow from said second sorption bed to said working fluid storage tank such that desorption occurs in said second sorption bed and heat of desorption is absorbed from said application requiring cooling.

11. The thermal energy transfer system of claim 1 further including a control system comprising;

electronic hardware, computer logic, thermostat, wherein said control system selects operational parameters including an energy source and a time selected from the group consisting of;

electricity energy and a time determined by said computer logic to operate said pump when electricity cost is cheapest, electricity energy and a time determined by said computer logic to operate said pump when environmental conditions are calculated to minimize cost, electricity energy and a time determined by computer logic to operate said pump when environmental conditions are calculated to maximize efficiency, solar energy and a time to operate said pump when captured solar energy is enough to power said pump, and wind energy and a time to operate said pump when captured wind energy is enough to power said pump, and energy stored in the form of a pressure differential between said working fluid in said first sorption bed and working fluid in said first selected element and a time determined by said thermostat to open said valve;

and at the selected time, said selected thermal transfer application is performed by said working fluid undergoing said selected process.

12. The thermal energy transfer system of claim 1 comprising;

a condenser, an evaporator, wherein claim 16 is performed at a first time, and at a second time said first sorption bed is subjected to external heat input from one selected from the group consisting of; said first sorption bed is heated by burning a fuel, said first sorption bed is heated by solar energy, said first sorption bed is heated by an electric heater, and said first sorption bed is heated by waste thermal energy;

said external heat input causes said working fluid desorption within said first sorption bed and increased pressure therein drives said working fluid into said condenser where said working fluid undergoes a phase transformation from a gas to a liquid, said working fluid then being transferred to said evaporator where said working fluid undergoes an evaporation phase transformation from a liquid to a gas and heat of evaporation is absorbed from said application requiring cooling.

13. The thermal energy transfer system of claim 1 comprising an electric generator wherein energy stored in the form of a pressure differential between said working fluid in said first sorption bed and said working fluid in said first selected element is transformed into electric current by causing said electric generator to turn as said working fluid flows from a higher pressure to a lower pressure.

14. The thermal energy transfer system of claim 1 comprising a water supply system wherein the said working fluid comprises water and at least one is true selected from the group consisting of, after being utilized as said working fluid said water is placed into said water supply system, before being utilized as said working fluid said water is extracted from said water supply system.

15. The thermal energy transfer system of claim 1 wherein said closed working fluid supply containment system is selected and includes an attribute selected from the group consisting of;

a fuel supply system that selectively supplies fuel to a burning process wherein said working fluid alternately serves as said fuel to said burning process, a water supply system that selectively supplies water for a use other than adsorption or desorption, and a hydrogen supply system that selectively supplies hydrogen to a process that generates electricity.

16. A thermal energy transfer system comprising;

a pump, a working fluid, a first sorption bed, a valve, a first element selected from the group consisting of, a second sorption bed, a working fluid storage tank, and a closed working fluid supply containment system, a thermal transfer application selected from the group consisting of; an application requiring heat, and an application requiring cooling;

wherein said working fluid undergoes a process selected from the group consisting of;

said working fluid pressure within said first element is lower than working fluid pressure within said first sorption bed, said valve is opened so that said working fluid is released from said first sorption bed to the selected first element, and desorption of said working fluid within said first sorption bed occurs as pressure decreases, and a heat of desorption is absorbed from said application requiring cooling, then said working fluid pressure within said first element is higher than said working fluid pressure within said first sorption bed, said pump takes said working fluid from said first sorption bed and places it within said first element, lowering the pressure of said working fluid within said first sorption bed, and desorption of said working fluid within said first sorption bed occurs as pressure decreases, and a heat of desorption is absorbed from said application requiring cooling, and working fluid pressure within said first element is higher than working fluid pressure within said first sorption bed, said valve is opened so that said working fluid flows from said first selected element to said first sorption bed, and adsorption of said working fluid within said first sorption bed occurs as pressure within said first sorption bed increases, and a heat of adsorption is produced and applied to said application requiring heat, then working fluid pressure within said first element is lower than working fluid pressure within said first sorption bed, and said pump takes said working fluid from the selected first element, and transfers said working fluid into said first sorption bed thereby increasing pressure within said first sorption bed, and adsorption of said working fluid within said first sorption bed occurs as pressure increases, and a heat of adsorption is produced and applied to said application requiring heat.

* * * * *